US009330672B2

(12) United States Patent
Guan et al.

(10) Patent No.: US 9,330,672 B2
(45) Date of Patent: May 3, 2016

(54) FRAME LOSS COMPENSATION METHOD AND APPARATUS FOR VOICE FRAME SIGNAL

(71) Applicant: ZTE CORPORATION, Shenzhen, Guangdong Province (CN)

(72) Inventors: Xu Guan, Shenzhen (CN); Hao Yuan, Shenzhen (CN); Ke Peng, Shenzhen (CN); Jiali Li, Shenzhen (CN)

(73) Assignee: ZTE Corporation (CN)

( * ) Notice: Subject to any disclaimer, the term of this patent is extended or adjusted under 35 U.S.C. 154(b) by 92 days.

(21) Appl. No.: 14/353,695

(22) PCT Filed: Sep. 29, 2012

(86) PCT No.: PCT/CN2012/082456

§ 371 (c)(1),
(2) Date: Aug. 4, 2014

(87) PCT Pub. No.: WO2013/060223

PCT Pub. Date: May 2, 2013

(65) Prior Publication Data

US 2014/0337039 A1 Nov. 13, 2014

(30) Foreign Application Priority Data

Oct. 24, 2011 (CN) ..... 2011 1 0325869

(51) Int. Cl.
*G10L 19/02* (2013.01)
*G10L 19/005* (2013.01)

(52) U.S. Cl.
CPC ..... *G10L 19/02* (2013.01); *G10L 19/005* (2013.01); *G10L 19/0212* (2013.01)

(58) Field of Classification Search
None
See application file for complete search history.

(56) References Cited

U.S. PATENT DOCUMENTS

2004/0006462 A1* 1/2004 Johnson ..... H04W 88/181 704/214
2008/0033718 A1 2/2008 Zopf et al.
(Continued)

FOREIGN PATENT DOCUMENTS

CN 1984203 6/2007
CN 101256774 9/2008
(Continued)

OTHER PUBLICATIONS

Wang, Chaopeng, Research on Audio Packet Loss Compensation, Electronic Technology & Information Science, China Master's Theses Full-Text Database, Jul. 15, 2010, pp. I136-I177, No. 7.
(Continued)

*Primary Examiner* — Jeremiah Bryar
(74) *Attorney, Agent, or Firm* — Plumsea Law Group, LLC

(57) ABSTRACT

A frame loss compensation method and apparatus for audio signals are disclosed. The method includes: when a first frame immediately following a correctly received frame is lost, judging a frame type of the first lost frame, and when the first lost frame is a non-multi-harmonic frame, calculating MDCT coefficients of the first lost frame by using MDCT coefficients of one or more frames prior to the first lost frame; obtaining an initially compensated signal of the first lost frame according to the MDCT coefficients of the first lost frame; and performing a first class of waveform adjustment on the initially compensated signal of the first lost frame and taking an adjusted time-domain signal as a time-domain signal of the first lost frame. The apparatus includes a frame type judgment module, an MDCT coefficient acquisition module, an initial compensation signal acquisition module and an adjustment module.

20 Claims, 9 Drawing Sheets

(56) References Cited

U.S. PATENT DOCUMENTS

| | | | | |
|---|---|---|---|---|
| 2009/0076805 | A1 | 3/2009 | Xu et al. | |
| 2009/0306994 | A1* | 12/2009 | Chon | G10L 19/025 704/500 |
| 2009/0316598 | A1 | 12/2009 | Zhan et al. | |
| 2010/0286805 | A1 | 11/2010 | Gao et al. | |
| 2012/0109659 | A1* | 5/2012 | Wu | G10L 19/0212 704/500 |
| 2013/0262122 | A1* | 10/2013 | Kim | G10L 19/02 704/268 |
| 2014/0088974 | A1* | 3/2014 | Mittal | G10L 19/005 704/500 |
| 2014/0337039 | A1* | 11/2014 | Guan | G10L 19/02 704/500 |

FOREIGN PATENT DOCUMENTS

| | | |
|---|---|---|
| CN | 101308660 | 11/2008 |
| CN | 101471073 | 7/2009 |
| CN | 101894558 | 11/2010 |
| CN | 101958119 | 1/2011 |
| KR | 20070059860 | 6/2007 |
| WO | 0133788 | 5/2001 |

OTHER PUBLICATIONS

Du, Yong et al., Packet-Loss Recovery Techniques for Voice Delivery over Internet, Tianjin Communications Technology, Mar. 2004, pp. 21-24, No. 1.

Hu, Yi et al., Design and Implementation of the Reconstruction Algorithm of the Lost Speech Packets, Computer Engineering & Science, Jun. 2001, pp. 32-34, vol. 23.

Huang, Huahua et al., A New Packet Loss Concealment Method Based on PAOLA, Audio Engineering, Apr. 2007, pp. 53-55, vol. 31.

European Search Report mailed Mar. 17, 2015 in European Patent Application 12 844 200.1.

* cited by examiner

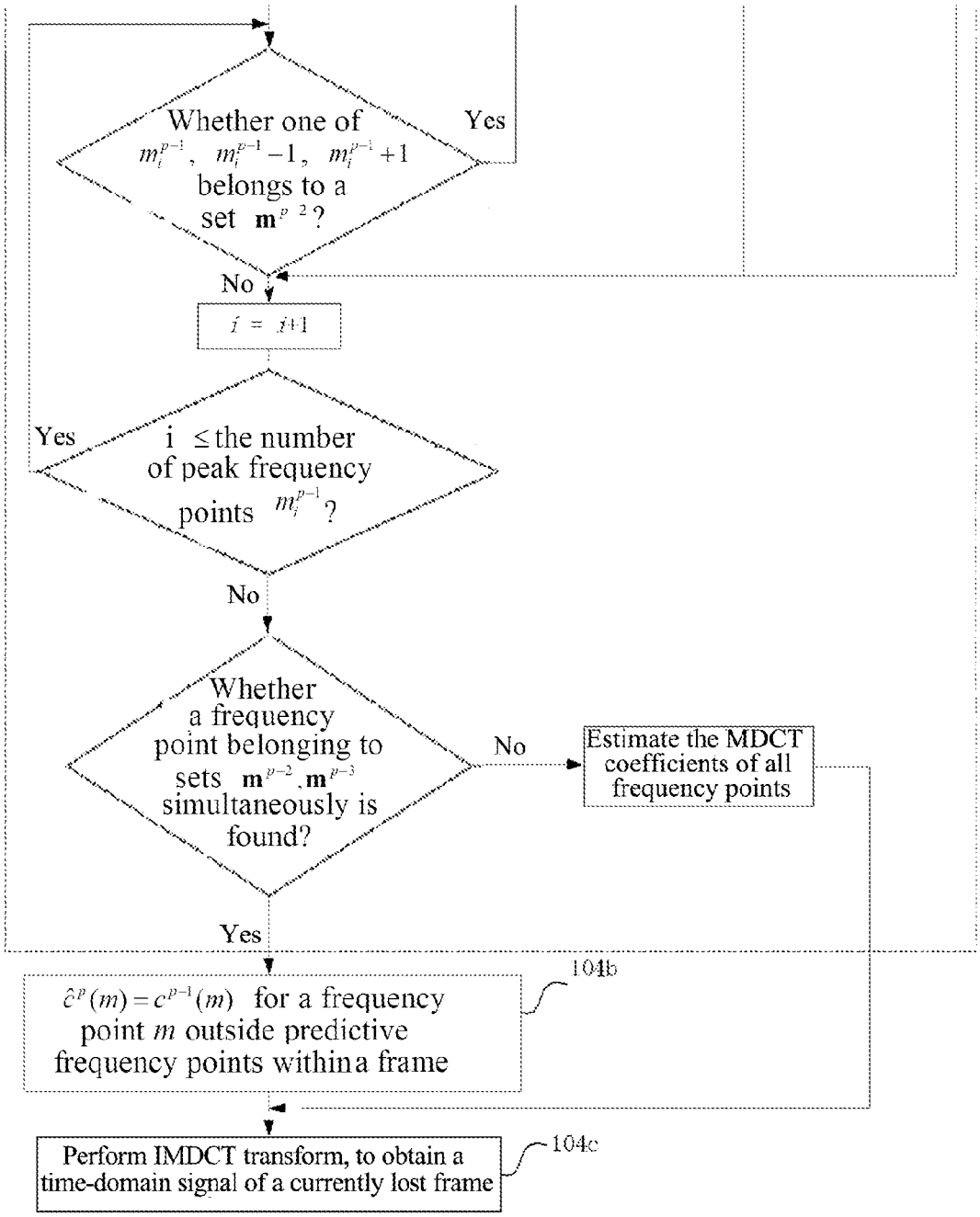
FIG. 5(continue)

FRAME LOSS COMPENSATION METHOD AND APPARATUS FOR VOICE FRAME SIGNAL

TECHNICAL FIELD

The present document relates to the field of voice frame encoding and decoding, and in particular, to a frame loss compensation method and apparatus for Modified Discrete Cosine Transform (MDCT) domain audio signals.

BACKGROUND OF THE RELATED ART

The packet technology is widely applied in network communication, and various forms of information such as voice or audio data are encoded and then are transmitted using the packet technology over the network, such as Voice over Internet Protocol (VoIP) etc. Due to the limitation of the transmission capacity of the information transmitting end or the loss of frame information caused by that packet information frames do not arrive at the buffer of the receiving end within the specified delay time or network congestions and jams etc., a sharp decrease of the quality of synthetic speech of the decoding end is caused, and therefore, it needs to compensate the data of the lost frames using a compensation technology. The frame loss compensation technology is a technology of mitigating decrease of the quality of speech due to the loss of frames.

The simplest mode of the related frame loss compensation for a transform field voice frame is to repeat a transform domain signal of a prior frame or substitute with a mute. Although this method is simple to implement and does not have a delay, the compensation effect is modest. Other compensation modes, such as Gap Data Amplitude Phase Estimation Technique (GAPES), need to firstly convert Modified Discrete Cosine Transform (MDCT) coefficients into Discrete Short Time Fourier Transform (DSTFT) coefficients, and then perform compensation, which have a high computational complexity and a large memory consumption; and another mode is to use a noise shaping and inserting technology to perform frame loss compensation on the voice frame, which has a good compensation effect on the noise-like signals, but has a very poor effect on the multi-harmonic audio signal.

In conclusion, most of the related frame loss compensation techniques of a transform field have an unobvious effect, and have a high computational complexity and an overlong delay, or have a poor compensation effect on some signals.

SUMMARY OF THE INVENTION

The technical problem to be solved by the embodiments of the present document is to provide a frame loss compensation method and apparatus for audio signals, so as to obtain better compensation effects and at the same time ensure that there is no delay and the complexity is low.

In order to solve the above problem, the embodiments of the present document provide a frame loss compensation method for audio signals, comprising:

when a first frame immediately following a correctly received frame is lost, judging a frame type of the first lost frame and when the first lost frame is a non-multi-harmonic frame, calculating MDCT coefficients of the first lost frame by using MDCT coefficients of one or more frames prior to the first lost frame;

obtaining an initially compensated signal of the first lost frame according to the MDCT coefficients of the first lost frame; and performing a first class of waveform adjustment on the initially compensated signal of the first lost frame and taking a time-domain signal obtained after adjustment as a time-domain signal of the first lost frame.

Preferably, judging a frame type of the first lost frame comprises: judging the frame type of the first lost frame according to frame type flag bits set by an encoding end in a code stream.

Preferably, the encoding end sets the frame type flag bits by means of: for a frame with remaining bits after being encoded, calculating a spectral flatness of the frame, and judging whether a value of the spectral flatness is less than a first threshold K, if so, considering the frame as a multi-harmonic frame, and setting the frame type flag bit as a multi-harmonic type, and if not, considering the frame as a non-multi-harmonic frame, and setting the frame type flag bit as a non-multi-harmonic type, and putting the frame type flag bit into the code stream to be transmitted to a decoding end; and for a frame without remaining bits after being encoded, not setting the frame type flag bit.

Preferably, judging the frame type of the first lost frame according to frame type flag bits set by an encoding end in a code stream comprises: acquiring a frame type flag of each of n frames prior to the first lost frame, and if a number of multi-harmonic frames in the prior n frames is larger than a second threshold $n_0$, and $0 \le n_0 \le n$, $n \ge 1$, considering the first lost frame as a multi-harmonic frame and setting the frame type flag as a multi-harmonic type; and if the number is not larger than the second threshold, considering the first lost frame as a non-multi-harmonic frame and setting the frame type flag as a non-multi-harmonic type.

Preferably, a frame type flag of each of n frames prior to the first lost frame is set by means of:

for each non-lost frame, judging whether there are remaining bits in the code stream after decoding, and if so, reading a frame type flag in the frame type flag bit from the code stream as the frame type flag of the frame, and if not, duplicating a frame type flag in the frame type flag bit of the prior frame as the frame type flag of the frame; and for each lost frame, acquiring a frame type flag of each of n frames prior to the currently lost frame, and if a number of multi-harmonic frames in the prior n frames is larger than a second threshold $n_0$, wherein $0 \le n_0 \le n$, $n \ge 1$, considering the currently lost frame as a multi-harmonic frame and setting the frame type flag as a multi-harmonic type; and if the number is not larger than the second threshold, considering the currently lost frame as a non-multi-harmonic frame and setting the frame type flag as a non-multi-harmonic type.

Preferably, performing a first class of waveform adjustment on the initially compensated signal of the first lost frame comprises: performing pitch period estimation and short pitch detection on the first lost frame, and performing waveform adjustment on the initially compensated signal of the first lost frame with a usable pitch period and without a short pitch period by means of: performing overlapped periodic extension on the time-domain signal of the frame prior to the first lost frame by taking a last pitch period of the time-domain signal of the frame prior to the first lost frame as a reference waveform to obtain a time-domain signal of a length larger than a frame length, wherein during the extension, a gradual convergence is performed from the waveform of the last pitch period of the time-domain signal of the prior frame to the waveform of the first pitch period of the initially compensated signal of the first lost frame, taking a first frame length of the time-domain signal in the time-domain signal of a length larger than a frame length obtained by the extension as a compensated time-domain signal of the first lost frame, and using a part exceeding the frame length for smoothing with a time-domain signal of a next frame.

Preferably, performing pitch period estimation on the first lost frame comprises: performing pitch search on the time signal of the frame prior to the first lost frame using an autocorrelation approach to obtain the pitch period and a largest normalized autocorrelation coefficient of the time-domain signal of the prior frame, and taking the obtained pitch period as an estimated pitch period value of the first lost frame; and judging whether the estimated pitch period value of the first lost frame is usable by means of: if any of the following conditions is satisfied, considering that the estimated pitch period value of the first lost frame is unusable:

a zero-crossing rate of the initially compensated signal of the first lost frame is larger than a third threshold $Z_1$, wherein $Z_1>0$;

the largest normalized autocorrelation coefficient of the time-domain signal of the frame prior to the first lost frame is less than a fourth threshold $R_1$ or a largest magnitude within the first pitch period of the time-domain signal of the frame prior to the first lost frame is $\lambda$ times larger than the largest magnitude within the last pitch period, wherein $0<R_1<1$ and $\lambda\geq 1$;

the largest normalized autocorrelation coefficient of the time-domain signal of the frame prior to the first lost frame is less than a fifth threshold $R_2$ or a zero-crossing rate the time-domain signal of the frame prior to the first lost frame is larger than a sixth threshold $Z_2$, wherein $0<R_2<1$ and $Z_2>0$.

Preferably, performing short pitch detection on the first lost frame comprises: detecting whether the frame prior to the first lost frame has a short pitch period, and if so, considering that the first lost frame also has the short pitch period, and if not, considering that the first lost frame does not have the short pitch period either; wherein, detecting whether the frame prior to the first lost frame has a short pitch period comprises: detecting whether the frame prior to the first lost frame has a pitch period between $T'_{min}$ and $T'_{max}$, wherein $T'_{min}$ and $T'_{max}$ satisfy a condition that $T'_{min}<T'_{max}\leq$a lower limit $T_{min}$ of the pitch period during the pitch search, during the detection, performing pitch search on the time-domain signal of the frame prior to the first lost frame using the autocorrelation approach, and when the largest normalized autocorrelation coefficient is larger than a seventh threshold $R_3$, considering that the short pitch period exists, wherein $0<R_3<1$.

Preferably, before performing waveform adjustment on the initially compensated signal of the first lost frame with a usable pitch period and without a short pitch period, the method further comprises: if the time-domain signal of the frame prior to the first lost frame is not a time-domain signal obtained by correctly decoding, performing adjustment on the estimated pitch period value obtained by the pitch period estimation.

Preferably, performing adjustment on the estimated pitch period value comprises: searching to obtain largest-magnitude positions $i_1$ and $i_2$ of the initially compensated signal of the first lost frame within time intervals $[0,T-1]$ and $[T,2T-1]$ respectively, wherein, T is an estimated pitch period value obtained by estimation, and if the following condition that $q_1T<i_2-i_1<q_2T$ and $i_2-i_1$ is less than a half of the frame length is satisfied wherein $0\leq q_1\leq 1\leq q_2$ modifying the estimated pitch period value to $i_2-i_1$, and if the above condition is not satisfied, not modifying the estimated pitch period value.

Preferably, performing overlapped periodic extension by taking a last pitch period of the time-domain signal of the frame prior to the first lost frame as a reference waveform comprises: performing periodic duplication later in time on the waveform of the last pitch period of the time-domain signal of the frame prior to the first lost frame taking the pitch period as a length, wherein during the duplication, a signal of a length larger than one pitch period is duplicated each time and an overlapped area is generated between the signal duplicated each time and the signal duplicated last time, and performing windowing and adding processing on the signals in the overlapped area.

Preferably, in a process of performing pitch period estimation on the first lost frame, before performing pitch search on the time-domain signal of the frame prior to the first lost frame using an autocorrelation approach, the method further comprises: firstly performing low-pass filtering or down-sampling processing on the initially compensated signal of the first lost frame and the time-domain signal of the frame prior to the first lost frame, and performing the pitch period estimation by substituting the original initially compensated signal and the time-domain signal of the frame prior to the first lost frame with the initially compensated signal and the time-domain signal of the frame prior to the first lost frame after the low-pass filtering or down-sampling.

Preferably, the method further comprises: for a second lost frame immediately following the first lost frame, judging a frame type of the second lost frame, and when the second lost frame is a non-multi-harmonic frame, calculating MDCT coefficients of the second lost frame by using MDCT coefficients of one or more frames prior to the second lost frame; obtaining an initially compensated signal of the second lost frame according to the MDCT coefficients of the second lost frame; and performing a second class of waveform adjustment on the initially compensated signal of the second lost frame and taking an adjusted time-domain signal as a time-domain signal of the second lost frame.

Preferably, performing a second class of waveform adjustment on the initially compensated signal of the second lost frame comprises: performing overlap-add on a part $M_1$ exceeding a frame length of the time-domain signal obtained during the compensation of the first lost frame and the initially compensated signal of the second lost frame to obtain a time-domain signal of the second lost frame, wherein, a length of the overlapped area is $M_1$, and in the overlapped area, a descending window is used for a part exceeding a frame length of the time-domain signal obtained during the compensation of the first lost frame and an ascending window with a same length as that of the descending window is used for data of the first $M_1$ samples of the initially compensated signal of the second lost frame, and data obtained by windowing and then adding is taken as data of the first $M_1$ samples of the time-domain signal of the second lost frame, and data of remaining samples are supplemented with data of samples of the initially compensated signal of the second lost frame outside the overlapped area.

Preferably, the method further comprises: for a third lost frame immediately following the second lost frame and a lost frame following the third lost frame, judging a frame type of the lost frame, and when the lost frame is a non-multi-harmonic frame, calculating MDCT coefficients of the lost frame by using MDCT coefficients of one or more frames prior to the lost frame; obtaining an initially compensated signal of the lost frame according to the MDCT coefficients of the lost frame; and taking the initially compensated signal of the lost frame as a time-domain signal of the lost frame.

Preferably, the method comprises: when a first frame immediately following a correctly received frame is lost and the first lost frame is a non-multi-harmonic frame, performing processing on the subsequent correctly received frame of the first lost frame as follows:

decoding to obtain the time-domain signal of the correctly received frame; performing adjustment on the estimated pitch period value used during the compensation of the first lost frame; and performing forward overlapped periodic extension by taking a last pitch period of the time-domain signal of the correctly received frame as a reference waveform to obtain a time-domain signal of a frame length; and performing overlap-add on a part exceeding a frame length of the time-domain signal obtained during the compensation of the first lost frame and the time-domain signal obtained by the extension, and taking the obtained signal as the time-domain signal of the correctly received frame.

Preferably, performing adjustment on the estimated pitch period value used during the compensation of the first lost frame comprises: searching to obtain largest-magnitude positions $i_3$ and $i_4$ of the time-domain signal of the correctly received frame within time intervals [L−2T−1, L−T−1] and [L−T,L−1] respectively, wherein, T is an estimated pitch period value used during the compensation of the first lost frame and L is a frame length, and if the following condition that $q_1T<i_4-i_3<q_2T$ and $i_4-i_3<L/2$ is satisfied wherein $0\le q_1\le 1\le q_2$, modifying the estimated pitch period value to $i_4-i_3$, and if the above condition is not satisfied, not modifying the estimated pitch period value.

Preferably, performing forward overlapped periodic extension by taking a last pitch period of the time-domain signal of the correctly received frame as a reference waveform to obtain a time-domain signal of a frame length comprises: performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

In order to solve the above problem, the present document further provides a frame loss compensation method for audio signals, comprising:

when a first frame immediately following a correctly received frame is lost, and the first lost frame is a non-multi-harmonic frame, processing a correctly received frame immediately following the first lost frame as follows;

decoding to obtain a time-domain signal of the correctly received frame; performing adjustment on an estimated pitch period value used during a compensation of the first lost frame; and performing forward overlapped periodic extension by taking a last pitch period of the time-domain signal of the correctly received frame as a reference waveform to obtain a time-domain signal of a frame length; and performing overlap-add on a part exceeding a frame length of the time-domain signal obtained during the compensation of the first lost frame and the time-domain signal obtained by the extension, and taking the obtained signal as the time-domain signal of the correctly received frame.

Preferably, performing adjustment on the estimated pitch period value used during the compensation of the first lost frame comprises: searching to obtain largest-magnitude positions $i_3$ and $i_4$ of the time-domain signal of the correctly received frame within time intervals [L−2T−1, L−T−1] and [L−T,L−1] respectively, wherein, T is the estimated pitch period value used during the compensation of the first lost frame and L is a frame length, and if the following condition that $q_1T<i_4-i_3<q_2T$ and $i_4-i_3<L/2$ is satisfied wherein $0\le q_1\le 1\le q_2$, modifying the estimated pitch period value to $i_4-i_3$, and if the above condition is not satisfied, not modifying the estimated pitch period value.

Preferably, performing forward overlapped periodic extension by taking a last pitch period of the time-domain signal of the correctly received frame as a reference waveform to obtain a time-domain signal of a frame length comprises: performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

In order to solve the above problem, the embodiments of the present document further provide a frame loss compensation apparatus for audio signals, comprising a frame type judgment module, a Modified Discrete Cosine Transform (MDCT) coefficient acquisition module, an initial compensation signal acquisition module and an adjustment module, wherein, the frame type judgment module is configured to judge a frame type of a first lost frame when a first frame immediately following a correctly received frame is lost;

the MDCT coefficient acquisition module is configured to calculate MDCT coefficients of the first lost frame by using MDCT coefficients of one or more frames prior to the first lost frame when the judgment module judges that the first lost frame is a non-multi-harmonic frame;

the initial compensation signal acquisition module is configured to obtain an initially compensated signal of the first lost frame according to the MDCT coefficients of the first lost frame; and the adjustment module is configured to perform a first class of waveform adjustment on the initially compensated signal of the first lost frame and take a time-domain signal obtained after adjustment as a time-domain signal of the first lost frame.

Preferably, the frame type judgment module is configured to judge a frame type of the first lost frame by means of: judging the frame type of the first lost frame according to a frame type flag bit set by an encoding apparatus in a code stream.

Preferably, the frame type judgment module is configured to judge the frame type of the first lost frame according to a frame type flag bit set by an encoding end in a code stream by means of: the frame type judgment module acquiring a frame type flag of each of n frames prior to the first lost frame, and if a number of multi-harmonic frames in the prior n frames is larger than a second threshold $n_0$, wherein $0\le n_0\le n$, $n\ge 1$, considering the first lost frame as a multi-harmonic frame and setting the frame type flag as a multi-harmonic type; and if the number is not larger than the second threshold, considering the first lost frame as a non-multi-harmonic frame and setting the frame type flag as a non-multi-harmonic type.

Preferably, the adjustment module includes a first class waveform adjustment unit, which includes a pitch period estimation unit, a short pitch detection unit and a waveform extension unit, wherein, the pitch period estimation unit is configured to perform pitch period estimation on the first lost frame;

the short pitch detection unit is configured to perform short pitch detection on the first lost frame;

the waveform extension unit is configured to perform waveform adjustment on the initially compensated signal of the first lost frame with a usable pitch period and without a short pitch period by means of: performing overlapped periodic extension on the time-domain signal of the frame prior to the first lost frame by taking a last pitch period of the time-domain signal of the frame prior to the first lost frame as a reference waveform to obtain a time-domain signal of a length larger than a frame length, wherein during the extension, a gradual convergence is performed from the waveform of the last pitch period of the time-domain signal of the prior frame to the waveform of the first pitch period of the initially compensated signal of the first lost frame, taking a first frame length of the time-domain signal in the time-domain signal of a length larger than a frame length obtained by the extension as a compensated time-domain signal of the first lost frame, and using a part exceeding the frame length for smoothing with a time-domain signal of a next frame.

Preferably, the pitch period estimation unit is configured to perform pitch period estimation on the first lost frame by means of: the pitch period estimation unit performing pitch search on the time signal of the frame prior to the first lost frame using an autocorrelation approach to obtain the pitch period and a largest normalized autocorrelation coefficient of the time-domain signal of the prior frame, and taking the obtained pitch period as an estimated pitch period value of the first lost frame; and the pitch period estimation unit judging whether the estimated pitch period value of the first lost frame is usable by means of: if any of the following conditions is satisfied, considering that the estimated pitch period value of the first lost frame is unusable:

a zero-crossing rate of the initially compensated signal of the first lost frame is larger than a third threshold $Z_1$, wherein $Z_1>0$;

the largest normalized autocorrelation coefficient of the time-domain signal of the frame prior to the first lost frame is less than a fourth threshold $R_1$ or a largest magnitude within the first pitch period of the time-domain signal of the frame prior to the first lost frame is $\lambda$ times larger than the largest magnitude within the last pitch period, wherein $0<R_1<1$ and $\lambda>1$;

the largest normalized autocorrelation coefficient of the time-domain signal of the frame prior to the first lost frame is less than a fifth threshold $R_2$ or a zero-crossing rate the time-domain signal of the frame prior to the first lost frame is larger than a sixth threshold $Z_2$, wherein $0<R_2<1$ and $Z_2>0$.

Preferably, the short pitch detection unit is configured to perform short pitch detection on the first lost frame by means of: the short pitch detection unit detecting whether the frame prior to the first lost frame has a short pitch period, and if so, considering that the first lost frame also has the short pitch period, and if not, considering that the first lost frame does not have the short pitch period either; wherein, the short pitch detection unit is configured to detect whether the frame prior to the first lost frame has a short pitch period by means of: detecting whether the frame prior to the first lost frame has a pitch period between $T'_{min}$ and $T'_{max}$, wherein $T'_{min}$ and $T'_{max}$ satisfy a condition that $T'_{min}<T'_{max}\leq$a lower limit $T_{min}$ of the period during the pitch search, during the detection, performing pitch search on the time-domain signal of the frame prior to the first lost frame using the autocorrelation approach, and when the largest normalized autocorrelation coefficient is larger than a seventh threshold $R_3$, considering that the short pitch period exists, wherein $0<R_3<1$.

Preferably, the first class waveform adjustment unit further comprises a pitch period adjustment unit, configured to perform adjustment on the estimated pitch period value obtained from estimation by the pitch period estimation unit and transmit the adjusted estimated pitch period value to the waveform extension unit when it is judged that the time-domain signal of the frame prior to the first lost frame is not a time-domain signal obtained by correctly decoding.

Preferably, the pitch period adjustment unit is configured to perform adjustment on the estimated pitch period value by means of: the pitch period adjustment unit searching to obtain largest-magnitude positions $i_1$ and $i_2$ of the initially compensated signal of the first lost frame within time intervals [0,T−1] and [T,2T−1] respectively, wherein, T is an estimated pitch period value obtained by estimation, and if the following condition that $g_1T<i_2-i_1<q_2T$ and $i_2-i_1$ is less than a half of the frame length is satisfied wherein $0\leq q_1\leq 1\leq q_2$, modifying the estimated pitch period value to $i_2-i_1$, and if the above condition is not satisfied, not modifying the estimated pitch period value.

Preferably, the waveform extension unit is configured to perform overlapped periodic extension by taking a last pitch period of the time-domain signal of the frame prior to the first lost frame as a reference waveform by means of: performing periodic duplication later in time on the waveform of the last pitch period of the time-domain signal of the frame prior to the first lost frame taking the pitch period as a length, wherein during the duplication, a signal of a length larger than one pitch period is duplicated each time and an overlapped area is generated between the signal duplicated each time and the signal duplicated last time, and performing windowing and adding processing on the signals in the overlapped area.

Preferably, the pitch period estimation unit is further configured to before performing pitch search on the time-domain signal of the frame prior to the first lost frame using an autocorrelation approach, firstly perform low-pass filtering or down-sampling processing on the initially compensated signal of the first lost frame and the time-domain signal of the frame prior to the first lost frame, and perform the pitch period estimation by substituting the original initially compensated signal and the time-domain signal of the frame prior to the first lost frame with the initially compensated signal and the time-domain signal of the frame prior to the first lost frame after low-pass filtering or down-sampling.

Preferably, the frame type judgment module is further configured to, when a second lost frame immediately following the first lost frame is lost, judge a frame type of the second lost frame;

the MDCT coefficient acquisition module is further configured to calculate MDCT coefficients of the second lost frame by using MDCT coefficients of one or more frames prior to the second lost frame when the frame type judgment module judges that the second lost frame is a non-multi-harmonic frame;

the initial compensation signal acquisition module is further configured to obtain an initially compensated signal of the second lost frame according to the MDCT coefficients of the second lost frame; and the adjustment module is further configured to perform a second class of waveform adjustment on the initially compensated signal of the second lost frame and take an adjusted time-domain signal as a time-domain signal of the second lost frame.

Preferably, the adjustment module further comprises a second class waveform adjustment unit, configured to perform a second class of waveform adjustment on the initially compensated signal of the second lost frame by means of: performing overlap-add on a part $M_1$ exceeding a frame length of the time-domain signal obtained during the compensation of the first lost frame and the initially compensated signal of the second lost frame to obtain a time-domain signal of the second lost frame, wherein, a length of the overlapped area is $M_1$, and in the overlapped area, a descending window is used for a part exceeding a frame length of the time-domain signal obtained during the compensation of the first lost frame and an ascending window with the same length as that of the descending window is used for data of the first $M_1$ samples of the initially compensated signal of the second lost frame, and data obtained by windowing and then adding is taken as data of the first $M_1$ samples of the time-domain signal of the second lost frame, and data of remaining samples are supplemented with data of samples of the initially compensated signal of the second lost frame outside the overlapped area.

Preferably, the frame type judgment module is further configured to when a third lost frame immediately following the second lost frame and a frame following the third lost frame are lost, judge frame types of the lost frames;

the MDCT coefficient acquisition module is further configured to calculate MDCT coefficients of the currently lost frame by using MDCT coefficients of one or more frames prior to the currently lost frame when the frame type judgment module judges that the currently lost frame is a non-multi-harmonic frame;

the initial compensation signal acquisition module is further configured to obtain an initially compensated signal of the currently lost frame according to the MDCT coefficients of the currently lost frame; and the adjustment module is further configured to take the initially compensated signal of the currently lost frame as a time-domain signal of the currently lost frame.

Preferably, the apparatus further comprises a normal frame compensation module, configured to, when a first frame immediately following a correctly received frame is lost and the first lost frame is a non-multi-harmonic frame, process a correctly received frame immediately following the first lost frame, wherein, the normal frame compensation module comprises a decoding unit, a time-domain signal adjustment unit, wherein, the decoding unit is configured to decode to obtain the time-domain signal of the correctly received frame; and the time-domain signal adjustment unit is configured to perform adjustment on the estimated pitch period value used during the compensation of the first lost frame; and perform forward overlapped periodic extension by taking a last pitch period of the time-domain signal of the correctly received frame as a reference waveform to obtain a time-domain signal of a frame length; and perform overlap-add on a part exceeding a frame length of the time-domain signal obtained during the compensation of the first lost frame and the time-domain signal obtained by the extension, and take the obtained signal as the time-domain signal of the correctly received frame.

Preferably, the time-domain signal adjustment unit is configured to perform adjustment on the estimated pitch period value used during the compensation of the first lost frame by means of: searching to obtain largest-magnitude positions $i_3$ and $i_4$ of the time-domain signal of the correctly received frame within time intervals $[L-2T-1, L-T-1]$ and $[L-T, L-1]$ respectively, wherein, T is an estimated pitch period value used during the compensation of the first lost frame and L is a frame length, and if the following condition that $q_1T<i_4-i_3<q_2T$ and $i_4-i_3<L/2$ is satisfied wherein $0\le q_1\le 1\le q_2$, modifying the estimated pitch period value to $i_4-i_3$, and if the above condition is not satisfied, not modifying the estimated pitch period value.

Preferably, the time-domain signal adjustment unit is configured to perform forward overlapped periodic extension by taking a last pitch period of the time-domain signal of the correctly received frame as a reference waveform to obtain a time-domain signal of a frame length by means of: performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

The frame loss compensation method and apparatus for audio signals proposed in the embodiments of the present document firstly judge a type of a lost frame, and then for a multi-harmonic lost frame, convert an MDCT-domain signal into an MDCT-MDST-domain signal and then perform compensation using technologies of phase extrapolation and amplitude duplication; and for a non-multi-harmonic lost frame, firstly perform initial compensation to obtain an initially compensated signal, and then perform waveform adjustment on the initially compensated signal to obtain a time-domain signal of the currently lost frame. The compensation method not only ensures the quality of the compensation of multi-harmonic signals such as music, etc., but also largely enhances the quality of the compensation of non-multi-harmonic signals such as voice, etc. The method and apparatus according to the embodiments of the present document have advantages such as no delay, low computational complexity and memory demand, ease of implementation, and good compensation performance etc.

PREFERRED EMBODIMENTS OF THE INVENTION

In the embodiments of the present document, a encoding end firstly judges a type of the original frame, and does not additionally occupy encoded bits when transmitting a judgment result to a decoding end (that is, the remaining encoded bits are used to transmit the judgment result and the judgment result will not be transmitted when there is no remaining bit). After the decoding end acquires judgment results of the types of n frames prior to the currently lost frame, the decoding end infers the type of the currently lost frame, and performs compensation on the currently lost frame by using a multi-harmonic frame loss compensation method or a non-multi-harmonic frame loss compensation method respectively according to whether the lost frame is a multi-harmonic frame or a non-multi-harmonic frame. For the multi-harmonic lost frame, an MDCT domain signal is transformed into a Modified Discrete Cosine Transform-Modified Discrete Sine Transform (MDCT-MDST) domain signal and then the compensation is performed using technologies of phase extrapolation, amplitude duplication etc.; and when the compensation is performed on the non-multi-harmonic lost frame, an MDCT coefficient value of the currently lost frame is calculated firstly using the MDCT coefficients of multiple frames prior to the currently lost frame (for example, MDCT coefficient of the prior frame after attenuation is used as an MDCT coefficient value of the currently lost frame), and then an initially compensated signal of the currently lost frame is obtained according to the MDCT coefficient of the currently lost frame, and then waveform adjustment is performed on the initially compensated signal to obtain a time-domain signal of the currently lost frame. With the non-multi-harmonic compensation method, it enhances the quality of compensation of the non-multi-harmonic frames such as voice frames etc.

The embodiments of the present document will be described in detail below in conjunction with accompanying drawings. It should be illustrated that, in the case of no conflict, the embodiments of this application and the features in the embodiments could be combined randomly with each other.

Embodiment One

Figure 1:
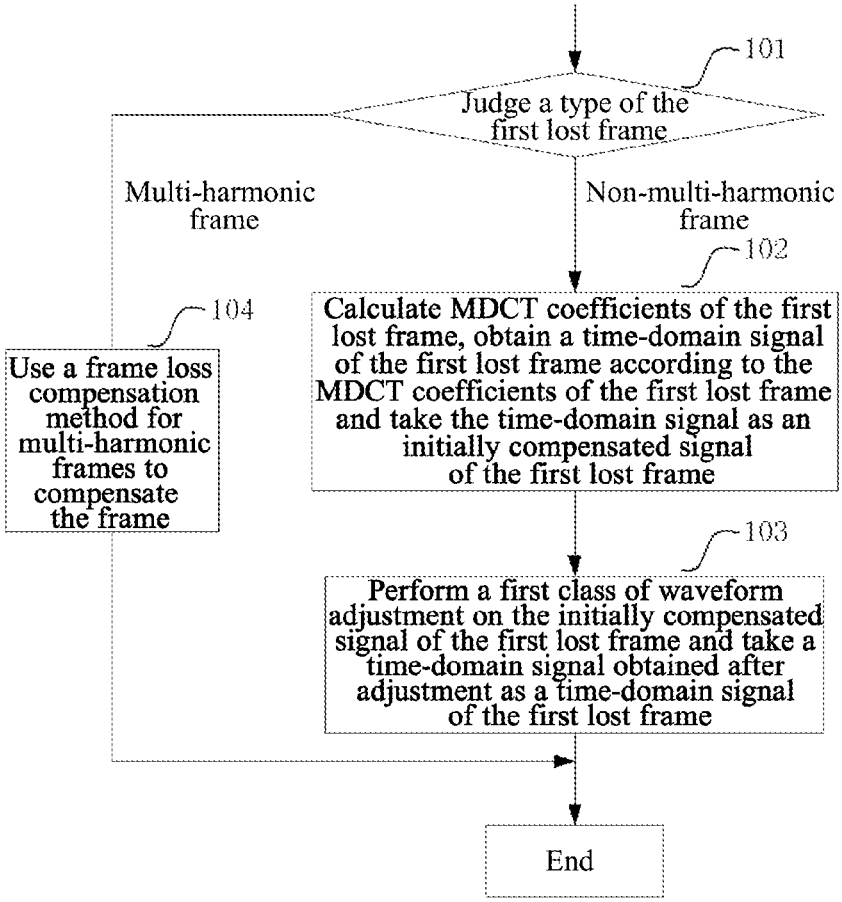
FIG. 1 is a flowchart of embodiment one of the present document.

The present embodiment describes a compensation method when a first frame immediately following a correctly received frame is lost, as shown in FIG. 1, comprises the following steps.

In step 101, it is to judge a type of the first lost frame, and when the first lost frame is a non-multi-harmonic frame, step 102 is performed, and when the first lost frame is not a non-multi-harmonic frame, step 104 is performed;

in step 102, when the first lost frame is a non-multi-harmonic frame, it is to calculate MDCT coefficients of the first lost frame by using MDCT coefficients of one or more frames prior to the first lost frame, and a time-domain signal of the first lost frame is obtained according to the MDCT coefficients of the first lost frame and the time-domain signal is taken as an initially compensated signal of the first lost frame; and The MDCT coefficient values of the first lost frame may be calculated by the following way: for example, values obtained by performing weighted average on the MDCT coefficients of the prior multiple frames and performing suitable attenuation may be taken as the MDCT coefficients of the first lost frame; alternatively, values obtained by duplicating MDCT coefficients of the prior frame and performing suitable attenuation may also be taken as the MDCT coefficients of the first lost frame.

The method of obtaining a time-domain signal according to the MDCT coefficients can be implemented using existing technologies, and the description thereof will be omitted herein.

The specific method of attenuating the MDCT coefficients is as follows.

When the currently lost frame is the $p^{th}$ frame, $$c^P(m)=\alpha^* c^{P-1}(m),\ m=0,\ldots M-1;$$

wherein, $c^P(m)$ represents an MDCT coefficient of the $p^{th}$ frame at a frequency point m, $\alpha$ is an attenuation coefficient, $0\leq\alpha\leq1$.

In step 103, a first class of waveform adjustment is performed on the initially compensated signal of the first lost frame and a time-domain signal obtained after adjustment is taken as a time-domain signal of the first lost frame, and then the processing ends;

in step 104, when the first lost frame is a multi-harmonic frame, a frame loss compensation method for multi-harmonic frames is used to compensate the frame, and the processing ends.

The steps 101, 103 and 104 will be described in detail below in conjunction with FIGS. 2, 3, 4 and 5 respectively.

Figure 2:
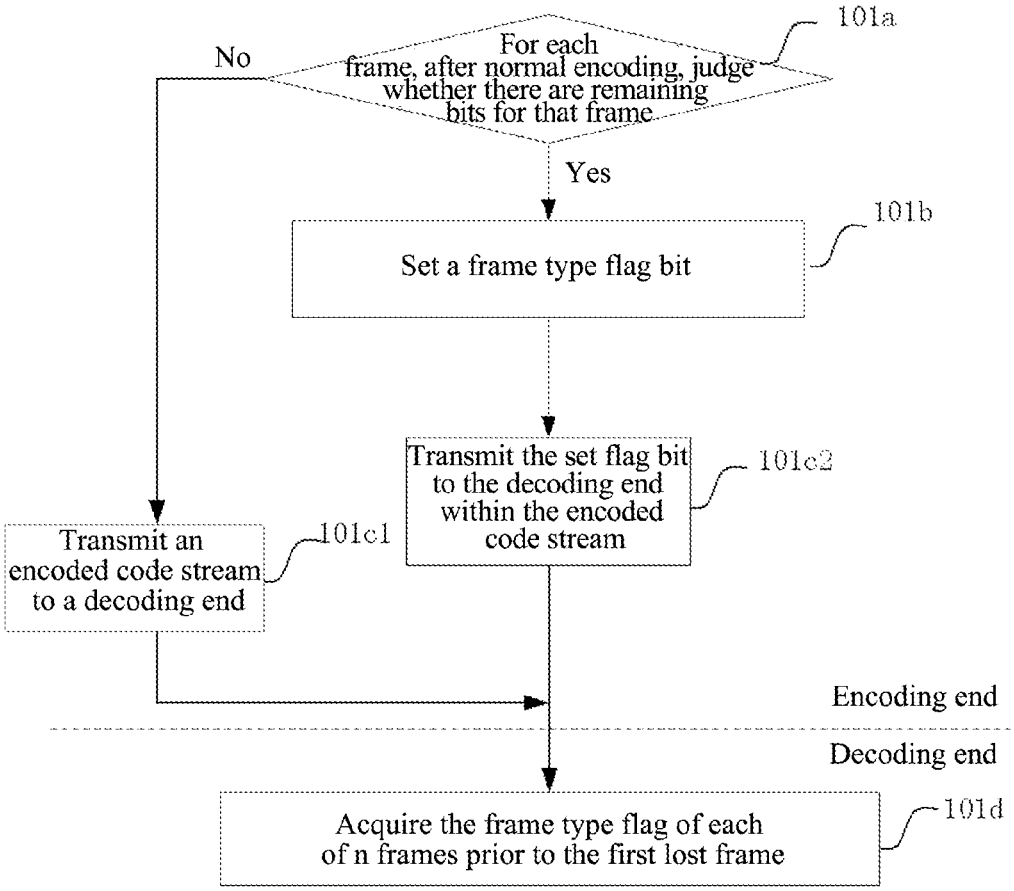
FIG. 2 is a flowchart of judging a frame type according to embodiment one of the present document.

As shown in FIG. 2, steps 101*a*-101*c* are implemented by the encoding end, and step 101*d* is implemented by the decoding end. The specific method of judging a type of the lost frame may include the following steps.

In step 101*a*, at the encoding end, for each frame, after normal encoding, it is judged whether there are remaining bits for that frame, that is, judging whether all available bits of one frame are used up after the frame is encoded, and if there are remaining bits, step 101*b* is performed; and if there is no remaining bit, step 101*c*1 is performed;

in step 101*b*, a spectral flatness of the frame is calculated and it is judged whether a value of the spectral flatness is less than a first threshold K, and if so, the frame is considered as a multi-harmonic frame, and the frame type flag bit is set as a multi-harmonic type (for example 1); and if not, the frame is considered as a non-multi-harmonic frame, and the frame type flag bit is set as a non-multi-harmonic type (for example 0), wherein $0\leq K\leq1$, and step 101*c*2 is performed;

the specific method of calculating the spectral flatness is as follows.

The spectral flatness SFM, of any the $i^{th}$ frame is defined as a ratio between a geometric mean and an arithmetic mean of signal magnitudes of the $i^{th}$ frame in a transform domain:

$$SFM_i=\frac{G_i}{A_i}$$

wherein, $$G_i=\left(\prod_{m=0}^{M-1}|c^i(m)|\right)^{\frac{1}{M}}$$

is the geometric mean of the signal magnitudes of the $i^{th}$ frame, $$A_i=\frac{1}{M}\sum_{m=0}^{M-1}|c^i(m)|$$

is the arithmetic mean of the signal magnitudes of the $i^{th}$ frame, $c^i$ (m) is an MDCT coefficient of the $i^{th}$ frame at a frequency point m, and M is the number of frequency points of the MDCT-domain signal.

Preferably, a part of all frequency points in the MDCT domain may be used to calculate the spectral flatness.

In step 101*c*1, the encoded code stream is transmitted to the decoding end;

in step 101*c*2, if there are remaining bits after the frame is encoded, the flag bit set in step 101*b* is transmitted to the decoding end within the encoded code stream;

in step 101*d*, at the decoding end, for each non-lost frame, it is judged whether there are remaining bits in the code stream after decoding, and if so, a frame type flag in the frame type flag bit is read from the code stream to be taken as the frame type flag of the frame and put into a buffer, and if not, a frame type flag in the frame type flag bit of the prior frame is duplicated to be taken as the frame type flag of the frame and put into the buffer; and for each lost frame, a frame type flag of each of n frames prior to the currently lost frame in the buffer is acquired, and if the number of multi-harmonic frames in the prior n frames is larger than a second threshold $n_0$ ($0 \le n_0 \le n$), it is considered that the currently lost frame is a multi-harmonic frame and the frame type flag bit is set as a multi-harmonic type (for example 1) and is put into a buffer; and if the number of multi-harmonic frames in the prior n frames is less than or equal to the second threshold $n_0$, it is considered that the currently lost frame is a non-multi-harmonic frame and the frame type flag bit is set as a non-multi-harmonic type (for example 0) and is put into the buffer wherein $n \ge 1$.

The present document is not limited to judge the frame type using the feature of spectral flatness, and other features can also be used for judgment, for example, the zero-crossing rate or a combination of several features is used for judgment. This is not limited in the present document.

Figure 3:
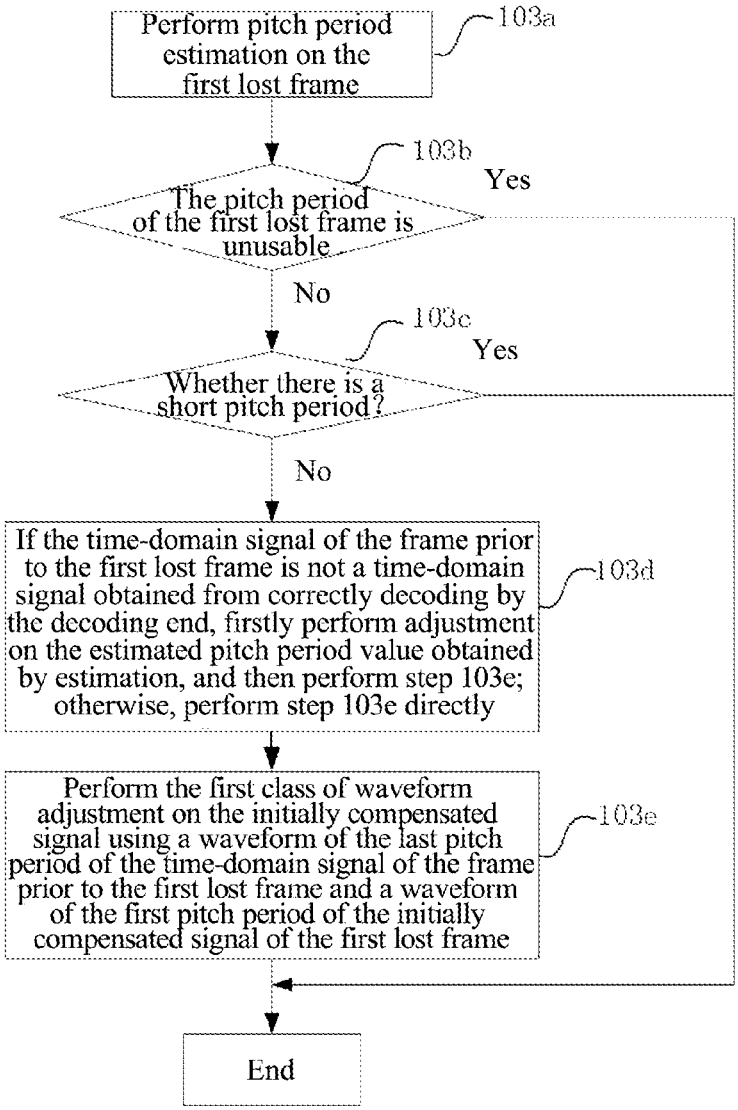
FIG. 3 is a flowchart of a first class of waveform adjustment method according to embodiment one of the present document.

FIG. 3 specifically describes a method of performing a first class of waveform adjustment on the initially compensated signal of the first lost frame with respect to step 103, which may include the following steps.

In step 103*a*, pitch period estimation is performed on the first lost frame. The specific pitch period estimation method is as follows.

Firstly, pitch period search is performed on the time-domain signal of the frame prior to the first lost frame using an autocorrelation approach, to obtain the pitch period of the time-domain signal of the prior frame and the largest normalized autocorrelation coefficient, and the obtained pitch period is taken as an estimated pitch period value of the first lost frame;

i.e., it is to search for $t \in [T_{min}, T_{max}]$, $0 < T_{min} < T_{max} < M$, so that $$\frac{\sum_{i=0}^{M-t-1} s(i)s(i+t)}{\left(\sum_{i=0}^{M-t-1} s(i)^2 \times \sum_{i=t}^{M-1} s(i)^2\right)^{1/2}}$$

achieves the largest value which is the largest normalized autocorrelation coefficient, and at this time, t is the pitch period, wherein $T_{min}$ and $T_{max}$ are an upper limit and a lower limit of the pitch search respectively, M is a frame length, s(i), i=1, . . . , M is a time-domain signal on which the pitch search will be performed;

although the estimated pitch period value of the first lost frame is estimated, the estimated value may not be usable, and it can be judged whether the estimated pitch period value of the first lost frame is usable by means of:

if any of the following three conditions is satisfied, considering that the estimated pitch period value of the first lost frame is unusable;

a zero-crossing rate of the initially compensated signal of the first lost frame is larger than a third threshold $Z_1$, wherein $Z_1 > 0$;

the largest normalized autocorrelation coefficient of the time-domain signal of the frame prior to the first lost frame is less than a fourth threshold $R_1$ or the largest magnitude within the first pitch period of the time-domain signal of the frame prior to the first lost frame is $\lambda$ times larger than the largest magnitude within the last pitch period, wherein $0 < R_1 < 1$ and $\lambda \ge 1$;

the largest normalized autocorrelation coefficient of the time-domain signal of the frame prior to the first lost frame is less than a fifth threshold $R_2$ or a zero-crossing rate of the time-domain signal of the frame prior to the first lost frame is larger than a sixth threshold $Z_2$, wherein $0 < R_2 < 1$ and $Z_2 > 0$.

Particularly, in the process of performing pitch period estimation, before performing pitch search on the time-domain signal of the frame prior to the first lost frame, the following processing may also be performed firstly: firstly performing low-pass filtering or down-sampling processing on the time-domain signal of the frame prior to the first lost frame and the initially compensated signal of the first lost frame, and then performing the pitch period estimation by substituting the original time-domain signal of the prior frame and the initially compensated signal of the first lost frame with the time-domain signal of the frame prior to the first lost frame and the initially compensated signal of the first lost frame after the low-pass filtering or down-sampling. The low-pass filtering or down-sampling process can reduce the effluence of the high-frequency components of the signal on the pitch search or reduce complexity of the pitch search.

In step 103*b*, if the pitch period of the first lost frame is unusable, the waveform adjustment is not performed on the initially compensated signal of the frame, and the process ends; and if the pitch period is usable, step 103*c* is performed;

in step 103*c*, short pitch detection is performed on the first lost frame, and if there is a short pitch period, the waveform adjustment is not performed on the initially compensated signal of the frame, and the process ends; and if there is no short pitch period, step 103*d* is performed;

performing short pitch detection on the first lost frame comprises: detecting whether a frame prior to the first lost frame has a short pitch period, and if so, considering that the first lost frame also has a short pitch period, and if not, considering that the first lost frame does not have a short pitch period either, that is, taking a detection result of the short pitch period of the frame prior to the first lost frame as the detection result of the short pitch period of the first lost frame.

It is detected whether a frame prior to the first lost frame has a short pitch period by means of:

detecting whether the frame prior to the first lost frame has a short pitch period between $T'_{min}$ and $T'_{max}$, wherein $T'_{min}$ and $T'_{max}$ satisfy a condition that $T'_{min} < T'_{max} \le$ a lower limit $T_{min}$ of the pitch period during the pitch search, during the detection, performing pitch search on the time-domain signal of the frame prior to the first lost frame using an autocorrelation approach, and when the largest normalized autocorrelation coefficient is larger than a seventh threshold $R_3$, considering that the short pitch period exists, wherein $0 < R_3 < 1$.

In step 103*d*, if the time-domain signal of the frame prior to the first lost frame is not a time-domain signal obtained from correctly decoding by the decoding end, adjustment is performed on the estimated pitch period value obtained by estimation, and then step 103*e* is performed, and if the time-domain signal of the frame prior to the first lost frame is a time-domain signal obtained from correctly decoding by the decoding end, step 103*e* is performed directly;

Here, the time-domain signal of the frame prior to the first lost frame being not a time-domain signal obtained from correctly decoding by the decoding end refers to assuming that the first lost frame is the $p^{th}$ frame, even if the decoding end can correctly receive the data packet of the $p-1^{th}$ frame, due to loss of the $p-2^{th}$ frame or other reasons, the time-domain signal of the $p-1^{th}$ frame can not be obtained by correctly decoding.

The specific method of adjusting the pitch period includes: denoting the pitch period obtained by estimation as T, searching to obtain largest-magnitude positions $i_1$ and $i_2$ of the initially compensated signal of the first lost frame within time intervals [0,T−1] and [T,2T−1] respectively, and if $q_1T<i_2-i_1<q_2T$ and $i_2-i_1$ is less than a half of the frame length, modifying the estimated pitch period value as $i_2-i_1$; otherwise, not modifying estimated pitch period value, wherein $0\le q_1\le 1\le q_2$.

In step 103*e*, the first class of waveform adjustment is performed on the initially compensated signal using a waveform of the last pitch period of the time-domain signal of the frame prior to the first lost frame and a waveform of the first pitch period of the initially compensated signal of the first lost frame, and the method of adjusting comprises: performing overlapped periodic extension on the time-domain signal of the frame prior to the first lost frame by taking the last pitch period of the time-domain signal of the prior frame as a reference waveform, to obtain a time-domain signal of a length larger than a frame length, for example, a time-domain signal of a length of $M+M_1$ samples. During the extension, a gradual convergence is performed from the waveform of the last pitch period of the time-domain signal of the prior frame to the waveform of the first pitch period of the initially compensated signal of the first lost frame. The first M samples in the time-domain signal of $M+M_1$ samples obtained by the extension is taken as a compensated time-domain signal of the first lost frame, and a part exceeding a frame length is used for smoothing with the time-domain signal of the next frame, wherein M is a frame length, $M_1$ is the number of samples exceeding the frame length, and $1\le M_1\le M$;

wherein, overlapped periodic extension refers to performing periodic duplication later in time taking the pitch period as a length, during the duplication, in order to ensure the signal smoothness, it needs to duplicate a signal of a length larger than one pitch period, and an overlapped area is generated between the signal duplicated each time and the signal duplicated last time, and windowing and adding processing need to be performed on the signals in the overlapped area. The specific method of obtaining a time-domain voice signal of a length larger than a frame length with overlapped periodic extension includes the following steps.

Figure 4A:
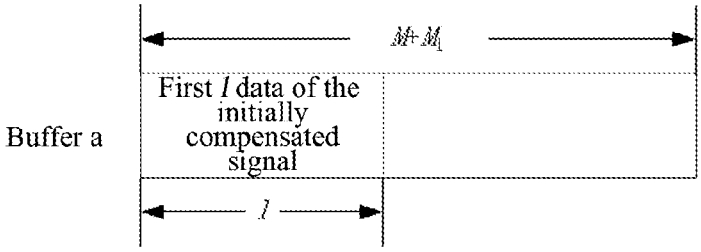
FIGS. 4*a-d* are diagrams of overlapped periodic extension according to embodiment one of the present document.
Figure 4B:
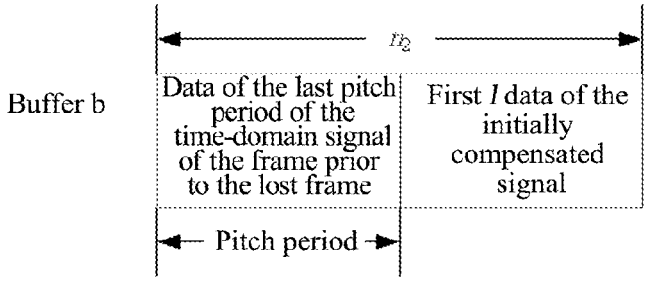

In step 103*ea*, data of the first l samples of the initially compensated signal is put into the first l units of a buffer a of a length of $M+M_1$, and an effective data length $n_1$ of the buffer a is set as 0, wherein l>0 is a length of the overlapped area, as shown in FIG. 4*a;* in step 103*eb*, the data of the last pitch period of the time-domain signal of the prior frame of the currently lost frame and the data of the first l samples of the initially compensated signal of the current frame are put into a buffer b, wherein a length $n_2$ of the buffer b=a pitch period+l; as shown in FIG. 4*b;* in step 103*ec*, the data in the buffer b are duplicated into a designated area of the buffer a, and the effective data length of the buffer a is added with one pitch period. The designated area refers to an area backward from the $n_1+1^{th}$ unit in the buffer a, and the length of the area is equal to the length $n_2$ of data in buffer b. During the duplication, the original data from the $n_1+1^{th}$ unit to the $n_1+l^{th}$ unit in the buffer a form an overlapped area of a length of l, and the data in the overlapped area need to be processed particularly as follows:

the original data of l samples in the overlapped area are multiplied with a descending window of a length of l, and the data duplicated from the buffer b into the overlapped area are multiplied with an ascending window of a length of l, and then the two parts of data are added to form the data in the overlapped area;

wherein, the descending window of a length of l and the ascending window of a length of l can be selected as a descending linear window and an ascending linear window, i.e., 1−i/l and i/l, i=0,1, . . . , l−1, or can also be selected as descending and ascending sine or cosine windows etc.

Particularly, when the data in the buffer b are duplicated into a designated area of the buffer a, if the remaining space $(M+M_1-n_1)$ in the buffer a is less than the length $n_2$ of data in the buffer b, the data actually to be duplicated into the buffer a are only the data of first $M+M_1-n_1$ samples in the buffer b.

Figure 4C:
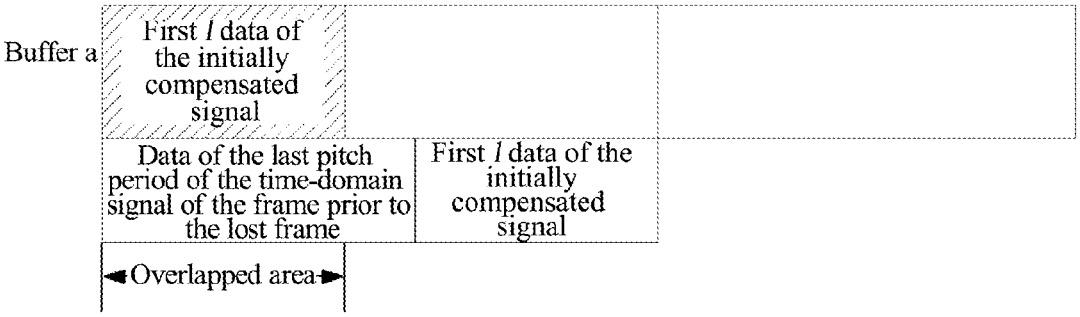
Figure 4D:
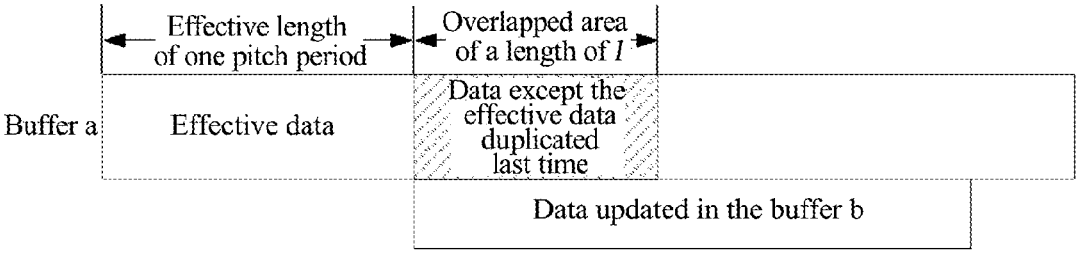

FIG. 4*c* illustrates a case of the first duplication, and in this figure, l less than the length of the pitch period is taken as an example, and in other embodiments, l may be equal to the length of the pitch period, or may also be larger than the length of the pitch period. FIG. 4*d* illustrates a case of the second duplication.

In step 103*ed*, the buffer b is updated, and the way of updating is to perform data-wise weighted average on the original data in the buffer b and the data of the first $n_2$ samples of the initially compensated signal;

in step 103*ee*, the steps 103*ec* to 103*ed* are repeated until the effective data length of the buffer a is larger than or equal to $M+M_1$, and the data in buffer a are a time-domain signal of a length larger than a frame length.

Figure 5:
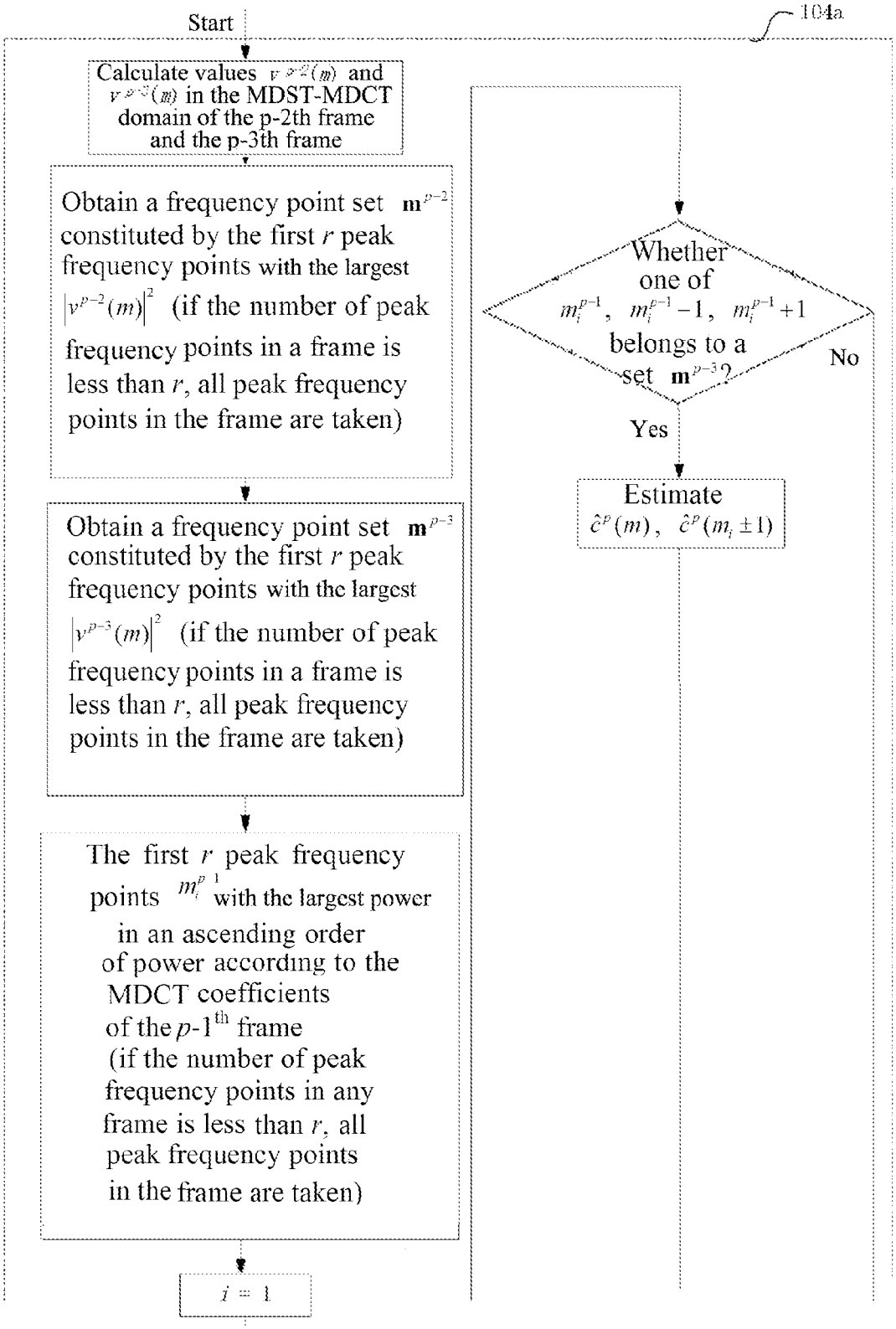
FIG. 5 is a flowchart of a multi-harmonic frame loss compensation method according to embodiment one of the present document.

FIG. 5 specifically describes a frame loss compensation method for a multi-harmonic frame with respect to step 104, which comprises:

when the $p^{th}$ frame is lost;

in step 104*a*, MDST coefficients $s^{p-2}(m)$ and $s^{p-3}(m)$ of the $p-2^{th}$ frame and the $p-3^{th}$ frame are obtained by using a Fast Modified Discrete Sine Transform (FMDST) algorithm according to the MDCT coefficient obtained by decoding multiple frames prior to the currently lost frame, and the obtained MDST coefficients of the $p-2^{th}$ frame and the $p-3^{th}$ frame and the MDCT coefficients $c^{p-2}(m)$ and $c^{p-3}(m)$ of the $p-2^{th}$ frame and the $p-3^{th}$ frame constitute complex signals of the MDCT-MDST domain:

$$v^{p-2}(m)=c^{p-2}(m)+js^{p-2}(m) \tag{1}$$

$$v^{p-3}(m)=c^{p-3}(m)+js^{p-3}(m) \tag{2}$$

wherein j is an imaginary symbol.

Powers $|v^{p-2}(m)|^2$, $|v^{p-3}(m)|^2$ of various frequency points in the $p-2^{th}$ frame and the $p-3^{th}$ frame are calculated, and the first r peak frequency points with the largest powers in the $p-2^{th}$ frame and the $p-3^{th}$ frame (if the number of peak frequency points in any frame is less than r, all peak frequency points in the frame are taken) constitute frequency point sets $m^{p-2}$, $m^{p-3}$, wherein, the peak frequency point refers to a frequency point with a power larger than those of adjacent samples, 1<r<M.

the powers of various frequency points in the $p-1^{th}$ frame are estimated according to the MDCT coefficients of the $p-1^{th}$ frame:

$$|v^{p-1}(m)|^2=[c^{p-1}(m)]^2+[c^{p-1}(m+1)-c^{p-1}(m-1)]^2 \tag{3}$$

wherein, $|\hat{v}^{p-1}(m)|^2$ is the power of the $p-1^{th}$ frame at a frequency point m, and $c^{p-1}(m)$ is the MDCT coefficient of the $p-1^{th}$ frame at the frequency point m, and so on.

The first r peak frequency points $m_i^{p-1}$ with the largest power in the $p-1^{th}$ frame are calculated, wherein i=1 . . . 10. If the number $N^{p-1}$ of peak frequency points in the frame is less than r, all peak frequency points $m_i^{p-1}$ in the frame are taken, wherein i=1 . . . $N^{p-1}$.

For each $m_i^{p-1}$, it is judged whether there is a frequency point of $m_i^{p-1}$, $m_i^{p-1}\pm1$ (the powers of the frequency points adjacent to the peak frequency point may also be large, and thus they are added into the set of peak frequency points of the $p-1^{th}$ frame) belonging to the sets $m^{p-2}$, $m^{p-3}$ simultaneously. If they belong to sets $m^{p-2}$, $m^{p-3}$ simultaneously, phases and amplitudes of the MDCT-MDST domain complex signal of the $p^{th}$ frame at frequency points $m_i^{p-1}$, $m_i^{p-1}\pm1$ are calculated according to the following equations (4)-(9) (as long as one of $m_i^{p-1}$, $m_i^{p-1}\pm1$, belong to $m^{p-2}$ and $m^{p-3}$ simultaneously, the following calculation will be performed on the three frequency points $m_i^{p-1}$, $m_i^{p-1}\pm1$):

$$\phi^{p-2}(m)=\angle v^{p-2}(m) \tag{4}$$

$$\phi^{p-3}(m)=\angle v^{p-3}(m) \tag{5}$$

$$A^{p-2}(m)=|v^{p-2}(m)| \tag{6}$$

$$A^{p-3}(m)=|v^{p-3}(m)| \tag{7}$$

$$\hat{\phi}^{p}(m)=\phi^{p-2}(m)+2[\phi^{p-2}(m)-\phi^{p-3}(m)] \tag{8}$$

$$\hat{A}^{p}(m)=A^{p-2}(m) \tag{9}$$

wherein, $\phi$ and A represent a phase and an amplitude respectively. For example, $\hat{\phi}^{p}(m)$ is an estimated phase value of the $p^{th}$ frame at the frequency point m, $\phi^{p-2}(m)$ is a phase of the $p-2^{th}$ frame at the frequency point m, $\phi^{p-3}(m)$ is a phase of the $p-3^{th}$ frame at the frequency point m, $\hat{A}^{p}(m)$ is an estimated amplitude value of the $p^{th}$ frame at the frequency point m, $A^{p-2}(m)$ is a phase of the $p-2^{th}$ frame at the frequency point m, and so on.

Therefore, the MDCT coefficient of the $p^{th}$ frame at the frequency point m obtained by compensation is:

$$\hat{c}^{p}(m)=\hat{A}^{p}(m)\cos[\hat{\phi}^{p}(m)] \tag{10}$$

If no frequency point of all of $m_i^{p-1}$ and $m_i^{p-1}\pm1$ belongs to sets $m^{p-2}$, $m^{p-3}$ simultaneously, the MDCT coefficients of all frequency points in the currently lost frame are estimated according to equations (4)-(10).

The frequency points needed to be predicted may also not be calculated, and the MDCT coefficients of all frequency points in the currently lost frame are estimated directly according to equations (4)-(10).

Sc is used to represent a set constituted by the above all frequency pints which are compensated according to equations (4)-(10).

In step 104*b*, for a frequency point outside $S_C$ in one frame, the MDCT coefficient values of the $p-1^{th}$ frame at the frequency point are used as the MDCT coefficient values of the $p^{th}$ frame at the frequency point;

in step 104*c*, the IMDCT transform is performed on the MDCT coefficients of the currently lost frame at all frequency points, to obtain the time-domain signal of the currently lost frame.

Embodiment Two

Figure 6:
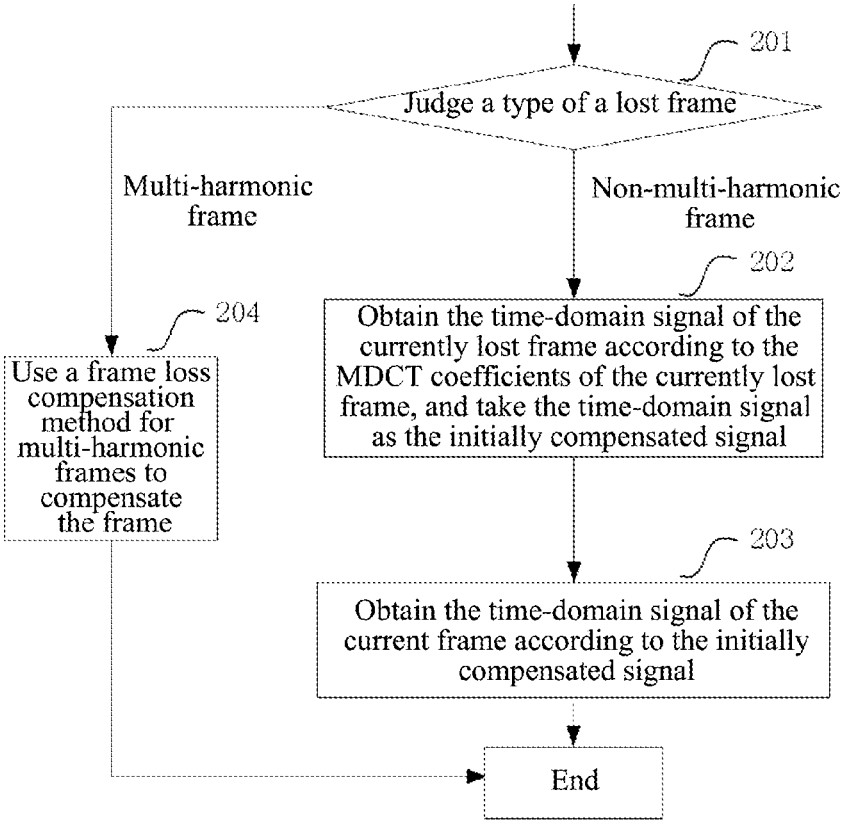
FIG. 6 is a flowchart of embodiment two of the present document.

The present embodiment describes a compensation method when more than two consecutive frames immediately following a correctly received frame are lost, and as shown in FIG. 6, the method comprises the following steps.

In step 201, a type of a lost frame is judged, and when the lost frame is a non-multi-harmonic frame, step 202 is performed, and when the lost frame is not a non-multi-harmonic frame, step 204 is performed;

in step 202, when the lost frame is a non-multi-harmonic frame, the MDCT coefficient values of the currently lost frame are calculated using the MDCT coefficients of one or more frames prior to the currently lost frame, and then the time-domain signal of the currently lost frame is obtained according to the MDCT coefficients of the currently lost frame, and the time-domain signal is taken as the initially compensated signal;

preferably, values obtained after performing weighted average and suitable attenuation on the MDCT coefficients of the prior multiple frames may be taken as the MDCT coefficients of the currently lost frame, alternatively, the MDCT coefficient of the prior frame may be duplicated and suitably attenuated to generate the MDCT coefficients of the currently lost frame;

in step 203, if the currently lost frame is a first lost frame following a correctly received frame, the time-domain signal of the first lost frame is obtained by compensation using the method in step 103; if the currently lost frame is a second lost frame following a correctly received frame, a second class of waveform adjustment is performed on the initially compensated signal of the currently lost frame, and the adjusted time-domain signal is taken as the time-domain signal of the current frame; and if the currently lost frame is a third or further subsequent lost frame following a correctly received frame, the initially compensated signal of the currently lost frame is directly taken as the time-domain signal of the current frame, and the process ends;

a specific second class of waveform adjustment method comprises:

performing overlap-add on a part (with a length denoted as $M_1$) exceeding a frame length of the time-domain signal obtained during the compensation of the first lost frame and the initially compensated signal of the currently lost frame (i.e., the second lost frame), to obtain a time-domain signal of the second lost frame. Wherein, a length of the overlapped area is $M_1$, and in the overlapped area, a descending window is used for the part exceeding a frame length of the time-domain signal obtained during the compensation of the first lost frame and an ascending window with the same length as that of the descending window is used for the data of the first $M_1$ samples of the initially compensated signal of the second lost frame, and the data obtained by windowing and then adding are taken as the data of the first $M_1$ samples of the time-domain signal of the second lost frame, and the data of remaining samples are supplemented with the data of the samples of the initially compensated signal of the second lost frame outside the overlapped area.

Wherein, the descending window and the ascending window can be selected to be a descending linear window and an ascending linear window, or can also be selected to be descending and ascending sine or cosine windows etc.

In step 204, when the lost frame is a multi-harmonic frame, the frame loss compensation method for multi-harmonic frames is used to compensate the frame, and the process ends.

Embodiment Three

Figure 7:
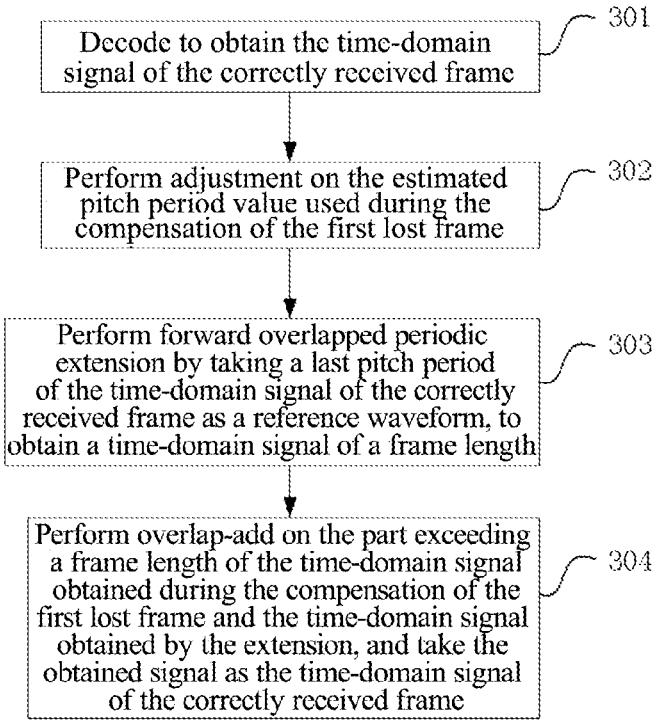
FIG. 7 is a flowchart of embodiment three of the present document.

The present embodiment describes a procedure of recovery processing after frame loss in a case that only one non-multi-harmonic frame is lost in the frame loss process. The present procedure needs not to be performed in a case that multiple frames are lost or the type of the lost frame is a multi-harmonic frame. As shown in FIG. 7, in the present embodiment, a first lost frame is a first lost frame immediately following a correctly received frame and the first lost frame is a non-multi-harmonic frame, and a correctly received frame addressed in FIG. 7 is a frame received correctly immediately following the first lost frame, and the method comprises the following steps.

In step 301, decoding is performed to obtain the time-domain signal of the correctly received frame;

in step 302, adjustment is performed on the estimated pitch period value used during the compensation of the first lost frame, which specifically comprises the following operation.

The estimated pitch period value used during the compensation of the first lost frame is denoted as T, and search is performed to obtain largest-magnitude positions $i_3$ band $i_4$ of the time-domain signal of the correctly received frame within time intervals [L−2T−1, L−T−1] and [L−T,L−1] respectively, and if $q_1T<i_4-i_3<q_2T$ and $i_4-i_3<L/2$, the estimated pitch period value is modified to $i_4-i_3$; otherwise, the estimated pitch period value is not modified, wherein L is a frame length, and $0\leq q_1\leq 1\leq q_2$.

In step 303, forward overlapped periodic extension is performed by taking the last pitch period of the time-domain signal of the correctly received frame as a reference waveform, to obtain a time-domain signal of a frame length;

The specific method of obtaining a time-domain signal of a frame length by means of overlapped periodic extension is similar to the method in step 103*e*, and the difference is that the direction of the extension is opposite, and there is no procedure of gradual waveform convergence. That is, periodic duplication is performed forward in time on the waveform of the last pitch period of the time-domain signal of the correctly received frame taking the pitch period as a length, until a time-domain signal of one frame length is obtained. During the duplication, in order to ensure the signal smoothness, it needs to duplicate a signal of a length larger than one pitch period, and an overlapped area is generated between the signal duplicated each time and the signal duplicated last time, and windowing and adding processing need to be performed on the signals in the overlapped area.

In step 304, overlap-add is performed on the part exceeding a frame length of the time-domain signal obtained during the compensation of the first lost frame (with a length denoted as $M_1$) and the time-domain signal obtained by the extension, and the obtained signal is taken as the time-domain signal of the correctly received frame.

Wherein, a length of the overlapped area is $M_1$, and in the overlapped area, a descending window is used for the part exceeding a frame length of the time-domain signal obtained during the compensation of the first lost frame and an ascending window with the same length as that of the descending window is used for the data of the first $M_1$ samples of the time-domain signal of the correctly received frame obtained by extension, and the data obtained by windowing and then adding are taken as the data of the first $M_1$ samples of the time-domain signal of the correctly received frame, and the data of remaining samples are supplemented with the data of the samples of the time-domain signal of the correctly received frame outside the overlapped area.

Wherein, the descending window and the ascending window can be selected to be a descending linear window and an ascending linear window, or can also be selected to be descending and ascending sine or cosine windows etc.

Embodiment Four

Figure 8:
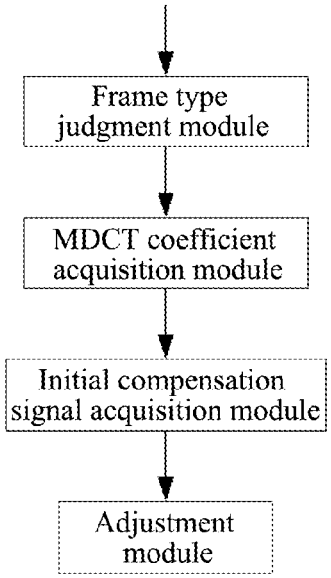
FIG. 8 is a structural diagram of a frame loss compensation apparatus according to embodiment four of the present document.

The present embodiment describes an apparatus for implementing the above method embodiment, and as shown in FIG. 8, the apparatus includes a frame type judgment module, an MDCT coefficient acquisition module, an initial compensation signal acquisition module and an adjustment module, wherein, the frame type judgment module is configured to, when a first frame immediately following a correctly received frame is lost, judge a frame type of the first frame which is lost, a first lost frame for short hereinafter;

the MDCT coefficient acquisition module is configured to calculate MDCT coefficients of the first lost frame by using MDCT coefficients of one or more frames prior to the first lost frame when the judgment module judges that the first lost frame is a non-multi-harmonic frame;

the initial compensation signal acquisition module is configured to obtain an initially compensated signal of the first lost frame according to the MDCT coefficients of the first lost frame; and the adjustment module is configured to perform a first class of waveform adjustment on the initially compensated signal of the first lost frame and take a time-domain signal obtained after adjustment as a time-domain signal of the first lost frame.

Preferably, the frame type judgment module is configured to judge a frame type of the first lost frame by means of: judging the frame type of the first lost frame according to a frame type flag bit set by an encoding apparatus in a code stream. Specifically, the frame type judgment module is configured to acquire a frame type flag of each of n frames prior to the first lost frame, and if the number of multi-harmonic frames in the prior n frames is larger than a second threshold $n_0$, wherein $0\leq n_0\leq n$, $n\geq 1$, consider the first lost frame as a multi-harmonic frame and set the frame type flag as a multi-harmonic type; and if the number is not larger than the second threshold, consider the first lost frame as a non-multi-harmonic frame and set the frame type flag as a non-multi-harmonic type.

Figure 9:
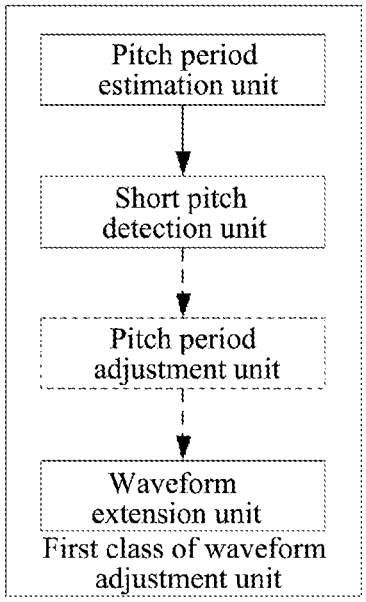
FIG. 9 is a structural diagram of a first class adjustment unit in the frame loss compensation apparatus according to embodiment four of the present document.

Preferably, the adjustment module includes a first class waveform adjustment unit, as shown in FIG. 9, which includes a pitch period estimation unit, a short pitch detection unit and a waveform extension unit, wherein, the pitch period estimation unit is configured to perform pitch period estimation on the first lost frame;

the short pitch detection unit is configured to perform short pitch detection on the first lost frame;

the waveform extension unit is configured to perform waveform adjustment on the initially compensated signal of the first lost frame with a usable pitch period and without a short pitch period by means of: performing overlapped periodic extension on the time-domain signal of the frame prior to the first lost frame by taking the last pitch period of the time-domain signal of the frame prior to the first lost frame as a reference waveform, to obtain a time-domain signal of a length larger than a frame length, wherein during the extension, a gradual convergence is performed from the waveform of the last pitch period of the time-domain signal of the prior frame to the waveform of the first pitch period of the initially compensated signal of the first lost frame, taking a first frame length of the time-domain signal in the time-domain signal of a length larger than a frame length obtained by the extension as a compensated time-domain signal of the first lost frame, and using a part exceeding the frame length for smoothing with the time-domain signal of the next frame.

Preferably, the pitch period estimation unit is configured to perform pitch period estimation on the first lost frame by means of: performing pitch search on the time signal of the frame prior to the first lost frame using an autocorrelation approach to obtain the pitch period and the largest normalized autocorrelation coefficient of the time-domain signal of the prior frame, and taking the obtained pitch period as an estimated pitch period value of the first lost frame; and the pitch period estimation unit judges whether the estimated pitch period value of the first lost frame is usable by means of: if any of the following conditions is satisfied, considering that the estimated pitch period value of the first lost frame is unusable:

a zero-crossing rate of the initially compensated signal of the first lost frame is larger than a third threshold $Z_1$, wherein $Z_1>0$;

the largest normalized autocorrelation coefficient of the time-domain signal of the frame prior to the first lost frame is less than a fourth threshold $R_1$ or the largest magnitude within the first pitch period of the time-domain signal of the frame prior to the first lost frame is $\lambda$ times larger than the largest magnitude within the last pitch period, wherein $0<R_1<1$ and $\lambda\geq1$;

the largest normalized autocorrelation coefficient of the time-domain signal of the frame prior to the first lost frame is less than a fifth threshold $R_2$ or a zero-crossing rate the time-domain signal of the frame prior to the first lost frame is larger than a sixth threshold $Z_2$, wherein $0<R_2<1$ and $Z_2>0$.

Preferably, the short pitch detection unit is configured to perform short pitch detection on the first lost frame by means of: detecting whether the frame prior to the first lost frame has a short pitch period, and if so, considering that the first lost frame also has the short pitch period, and if not, considering that the first lost frame does not have the short pitch period either; wherein, the short pitch detection unit is configured to detect whether the frame prior to the first lost frame has a short pitch period by means of: detecting whether the frame prior to the first lost frame has a pitch period between and $T'_{min}$ and $T'_{max}$, wherein $T'_{min}$ and $T'_{max}$ satisfy a condition that $T'_{min}<T'_{max}\leq$a lower limit $T_{min}$ of the pitch period during the pitch search, during the detection, performing pitch search on the time-domain signal of the frame prior to the first lost frame using the autocorrelation approach, and when the largest normalized autocorrelation coefficient is larger than a seventh threshold $R_3$, considering that the short pitch period exists, wherein $0<R_3<1$.

Preferably, the first class waveform adjustment unit further comprises a pitch period adjustment unit, configured to perform adjustment on the estimated pitch period value obtained from estimation by the pitch period estimation unit and transmit the adjusted estimated pitch period value to the waveform extension unit when it is judged that the time-domain signal of the frame prior to the first lost frame is not a time-domain signal obtained by correctly decoding.

Preferably, the pitch period adjustment unit is configured to perform adjustment on the estimated pitch period value by means of: searching to obtain largest-magnitude positions $i_1$ and $i_2$ of the initially compensated signal of the first lost frame within time intervals [0,T−1] and [T,2T−1] respectively, wherein, T is an estimated pitch period value obtained by estimation, and if the following condition that $q_1T<i_2-i_1<q_2T$ and $i_2-i_1$ is less than a half of the frame length is satisfied wherein $0\leq q_1\leq1\leq q_2$, modifying the estimated pitch period value to $i_2-i_1$, and if the above condition is not satisfied, not modifying the estimated pitch period value.

Preferably, the waveform extension unit is configured to perform overlapped periodic extension by taking the last pitch period of the time-domain signal of the frame prior to the first lost frame as a reference waveform by means of: performing periodic duplication later in time on the waveform of the last pitch period of the time-domain signal of the frame prior to the first lost frame taking the pitch period as a length, wherein during the duplication, a signal of a length larger than one pitch period is duplicated each time and an overlapped area is generated between the signal duplicated each time and the signal duplicated last time, and performing windowing and adding processing on the signals in the overlapped area.

Preferably, the pitch period estimation unit is further configured to before performing pitch search on the time-domain signal of the frame prior to the first lost frame using an autocorrelation approach, firstly perform low-pass filtering or down-sampling processing on the initially compensated signal of the first lost frame and the time-domain signal of the frame prior to the first lost frame, and perform the pitch period estimation by substituting the original initially compensated signal and the time-domain signal of the frame prior to the first lost frame with the initially compensated signal and the time-domain signal of the frame prior to the first lost frame after low-pass filtering or down-sampling.

Preferably, the above frame type judgment module, the MDCT coefficient acquisition module, the initial compensation signal acquisition module and the adjustment module may further have the following functions.

The frame type judgment module is further configured to when a second lost frame immediately following the first lost frame is lost, judge a frame type of the second lost frame;

the MDCT coefficient acquisition module is further configured to calculate MDCT coefficients of the second lost frame by using MDCT coefficients of one or more frames prior to the second lost frame when the frame type judgment module judges that the second lost frame is a non-multi-harmonic frame;

the initial compensation signal acquisition module is further configured to obtain an initially compensated signal of the second lost frame according to the MDCT coefficients of the second lost frame; and the adjustment module is further configured to perform a second class of waveform adjustment on the initially compensated signal of the second lost frame and take an adjusted time-domain signal as a time-domain signal of the second lost frame.

Preferably, the adjustment module further comprises a second class waveform adjustment unit, configured to perform a second class of waveform adjustment on the initially compensated signal of the second lost frame by means of:

performing overlap-add on the part $M_1$ exceeding a frame length of the time-domain signal obtained during the compensation of the first lost frame and the initially compensated signal of the second lost frame to obtain a time-domain signal of the second lost frame, wherein, a length of the overlapped area is $M_1$, and in the overlapped area, a descending window is used for the part exceeding a frame length of the time-domain signal obtained during the compensation of the first lost frame and an ascending window with the same length as that of the descending window is used for the data of the first $M_1$ samples of the initially compensated signal of the second lost frame, and the data obtained by windowing and then adding are taken as the data of the first $M_1$ samples of the time-domain signal of the second lost frame, and the data of remaining samples are supplemented with the data of the samples of the initially compensated signal of the second lost frame outside the overlapped area.

Preferably, the above frame type judgment module, the MDCT coefficient acquisition module, the initial compensation signal acquisition module and the adjustment module may further have the following functions.

The frame type judgment module is further configured to when a third lost frame immediately following the second lost frame and a frame following the third lost frame are lost, judge frame types of the lost frames;

the MDCT coefficient acquisition module is further configured to calculate MDCT coefficients of the currently lost frame by using MDCT coefficients of one or more frames prior to the currently lost frame when the frame type judgment module judges that the currently lost frame is a non-multi-harmonic frame;

the initial compensation signal acquisition module is further configured to obtain an initially compensated signal of the currently lost frame according to the MDCT coefficients of the currently lost frame; and the adjustment module is further configured to take the initially compensated signal of the currently lost frame as a time-domain signal of the lost frame.

Figure 10:
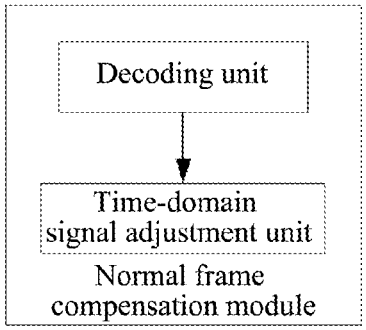
FIG. 10 is a structural diagram of a normal frame compensation module in the frame loss compensation apparatus according to embodiment four of the present document.

Preferably, the apparatus further comprises a normal frame compensation module, configured to when a first frame immediately following a correctly received frame is lost and the first lost frame is a non-multi-harmonic frame, process a correctly received frame immediately following the first lost frame, and as shown in FIG. 10, the normal frame compensation module comprises a decoding unit, a time-domain signal adjustment unit, wherein, the decoding unit is configured to decode to obtain the time-domain signal of the correctly received frame; and the time-domain signal adjustment unit is configured to perform adjustment on the estimated pitch period value used during the compensation of the first lost frame; and perform forward overlapped periodic extension by taking the last pitch period of the time-domain signal of the correctly received frame as a reference waveform to obtain a time-domain signal of a frame length; and perform overlap-add on the part exceeding a frame length of the time-domain signal obtained during the compensation of the first lost frame and the time-domain signal obtained by the extension, and take the obtained signal as the time-domain signal of the correctly received frame.

Preferably, the time-domain signal adjustment unit is configured to perform adjustment on the estimated pitch period value used during the compensation of the first lost frame by means of:

searching to obtain largest-magnitude positions $i_3$ and $i_4$ of the time-domain signal of the correctly received frame within time intervals [L−2T−1, L−T−1] and [L−T,L−1] respectively, wherein, T is an estimated pitch period value used during the compensation of the first lost frame and L is a frame length, and if the following condition that $q_1T<i_4-i_3<q_2T$ and $i_4-i_3<L/2$ is satisfied wherein $0\le q_1\le 1\le q_2$, modifying the estimated pitch period value to $i_4-i_3$, and if the above condition is not satisfied, not modifying the estimated pitch period value.

Preferably, the time-domain signal adjustment unit is configured to perform forward overlapped periodic extension by taking the last pitch period of the time-domain signal of the correctly received frame as a reference waveform to obtain a time-domain signal of a frame length by means of:

performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

The thresholds used in the embodiments herein are empirical values, and may be obtained by simulation.

A person having ordinary skill in the art can understand that all or part of steps in the above method can be implemented by programs instructing related hardware, and the programs can be stored in a computer readable storage medium, such as a read-only memory, disk or disc etc. Alternatively, all or part of steps in the above embodiments can also be implemented by one or more integrated circuits. Accordingly, each module/unit in the above embodiments can be implemented in a form of hardware, or can also be implemented in a form of software functional module. The present document is not limited to any particular form of a combination of hardware and software.

Of course, the present document can have a plurality of other embodiments. Without departing from the spirit and essence of the present document, those skilled in the art can make various corresponding changes and variations according to the present document, and all these corresponding changes and variations should belong to the protection scope of the appended claims in the present document.

INDUSTRIAL APPLICABILITY

The method and apparatus according to the embodiments of the present document have advantages such as no delay, low computational complexity and memory demand, ease of implementation, and good compensation performance etc.

What is claimed is:

1. A frame loss compensation method for audio signals, comprising:

when a first frame immediately following a correctly received frame is lost, judging a frame type of the first frame which is lost, a first lost frame for short hereinafter, and when the first lost frame is a non-multi-harmonic frame, calculating Modified Discrete Cosine Transform (MDCT) coefficients of the first lost frame by using MDCT coefficients of one or more frames prior to the first lost frame;

obtaining an initially compensated signal of the first lost frame according to the MDCT coefficients of the first lost frame; and performing a waveform adjustment on the initially compensated signal of the first lost frame and taking a time-domain signal obtained after adjustment as a time-domain signal of the first lost frame.

2. The method according to claim 1, wherein, judging a frame type of a first lost frame comprises:

judging the frame type of the first lost frame according to frame type flag bits set by an encoding end in a code stream.

3. The method according to claim 2, further comprising:

the encoding end setting the frame type flag bits by means of:

for a frame with remaining bits after being encoded, calculating a spectral flatness of the frame, and judging whether a value of the spectral flatness is less than a first threshold K, if so, considering the frame as a multi-harmonic frame, and setting the frame type flag bit as a multi-harmonic type, and if not, considering the frame as a non-multi-harmonic frame, and setting the frame type flag bit as a non-multi-harmonic type, and putting the frame type flag bit into the code stream to be transmitted to a decoding end; and for a frame without remaining bits after being encoded, not setting the frame type flag bit.

4. The method according to claim 2, wherein, judging the frame type of the first lost frame according to frame type flag bits set by an encoding end in a code stream comprises:

acquiring a frame type flag of each of n frames prior to the first lost frame, and if a number of multi-harmonic frames in the prior n frames is larger than a second threshold $n_0$, wherein n and $n_0$ are integers and $0 \leq_{n0} \leq n$, $n \geq 1$, considering the first lost frame as a multi-harmonic frame and setting the frame type flag as a multi-harmonic type; and if the number is not larger than the second threshold, considering the first lost frame as a non-multi-harmonic frame and setting the frame type flag as a non-multi-harmonic type, preferably, wherein, acquiring a frame type flag of each of n frames prior to the first lost frame comprises:

for each non-lost frame, judging whether there are remaining bits in the code stream after decoding, and if so, reading a frame type flag in the frame type flag bit from the code stream as the frame type flag of the frame, and if not, duplicating a frame type flag in the frame type flag bit of the prior frame as the frame type flag of the frame; and for each lost frame, acquiring a frame type flag of each of n frames prior to the currently lost frame, and if a number of multi-harmonic frames in the prior n frames is larger than a second threshold $n_0$, wherein $0 \leq n_0 \leq n$, $n \geq 1$, considering the currently lost frame as a multi-harmonic frame and setting the frame type flag as a multi-harmonic type;

and if the number is not larger than the second threshold, considering the currently lost frame as a non-multi-harmonic frame and setting the frame type flag as a non-multi-harmonic type.

5. The method according to claim 1, wherein, performing a waveform adjustment on the initially compensated signal of the first lost frame comprises:

performing pitch period estimation and short pitch detection on the first lost frame, and performing waveform adjustment on the initially compensated signal of the first lost frame with a usable pitch period and without a short pitch period by means of:

performing overlapped periodic extension on a time-domain signal of the frame prior to the first lost frame by taking a last pitch period of the time-domain signal of the frame prior to the first lost frame as a reference waveform to obtain a time-domain signal of a length larger than a frame length, wherein during the extension, a gradual convergence is performed from a waveform of the last pitch period of the time-domain signal of the prior frame to a waveform of the first pitch period of the initially compensated signal of the first lost frame, taking a first frame length of the time-domain signal in the time-domain signal of a length larger than a frame length obtained by the extension as a compensated time-domain signal of the first lost frame, and using a part exceeding a frame length for smoothing with a time-domain signal of a next frame.

6. The method according to claim 5, wherein, performing pitch period estimation on the first lost frame comprises:

performing pitch search on the time signal of the frame prior to the first lost frame using an autocorrelation approach, to obtain the pitch period and a largest normalized autocorrelation coefficient of the time-domain signal of the prior frame, and taking the obtained pitch period as an estimated pitch period value of the first lost frame; and judging whether the estimated pitch period value of the first lost frame is usable by means of: if any of the following conditions is satisfied, considering that the estimated pitch period value of the first lost frame is unusable:

a zero-crossing rate of the initially compensated signal of the first lost frame is larger than a third threshold $Z_1$, wherein $Z_1>0$;

the largest normalized autocorrelation coefficient of the time-domain signal of the frame prior to the first lost frame is less than a fourth threshold R.sub.1 or a largest magnitude within the first pitch period of the time-domain signal of the frame prior to the first lost frame is $\lambda$ times larger than the largest magnitude within the last pitch period, wherein $0<R_1<1$ and $\lambda \geq 1$;

the largest normalized autocorrelation coefficient of the time-domain signal of the frame prior to the first lost frame is less than a fifth threshold $R_2$ or a zero-crossing rate the time-domain signal of the frame prior to the first lost frame is larger than a sixth threshold $Z_2$, wherein $0<R_2<1$ and $Z_2>0$, preferably, wherein, in a process of performing pitch period estimation on the first lost frame, before performing pitch search on the time-domain signal of the frame prior to the first lost frame using an autocorrelation approach, the method further comprises:

firstly performing low-pass filtering or down-sampling processing on the initially compensated signal of the first lost frame and the time-domain signal of the frame prior to the first lost frame, and performing the pitch period estimation by substituting the original initially compensated signal and the time-domain signal of the frame prior to the first lost frame with the initially compensated signal and the time-domain signal of the frame prior to the first lost frame after low-pass filtering or down-sampling.

7. The method according to claim 5, wherein, performing short pitch detection on the first lost frame comprises: detecting whether the frame prior to the first lost frame has a short pitch period, and if so, considering that the first lost frame also has the short pitch period, and if not, considering that the first lost frame does not have the short pitch period either;

wherein, detecting whether the frame prior to the first lost frame has a short pitch period comprises:

detecting whether the frame prior to the first lost frame has a pitch period between $T'_{min}$ and $T_{max}$, wherein $T'_{min}$ and $T'_{max}$ satisfy a condition that $T'_{min}<T'_{max\leq}$a lower limit $T_{min}$ of the pitch period during the pitch search, during the detection, performing pitch search on the time-domain signal of the frame prior to the first lost frame using an autocorrelation approach, and when a largest normalized autocorrelation coefficient is larger than a seventh threshold $R_3$, considering that the short pitch period exists, wherein $0<R_3<1$, or, wherein, performing overlapped periodic extension by taking a last pitch period of the time-domain signal of the frame prior to the first lost frame as a reference waveform comprises:

performing periodic duplication later in time on the waveform of the last pitch period of the time-domain signal of the frame prior to the first lost frame taking the pitch period as a length, wherein during the duplication, a signal of a length larger than one pitch period is duplicated each time and an overlapped area is generated between the signal duplicated each time and the signal duplicated last time, and performing windowing and adding processing on the signals in the overlapped area.

8. The method according to claim 5, wherein, before performing waveform adjustment on the initially compensated signal of the first lost frame with a usable pitch period and without a short pitch period, the method further comprises:

if the time-domain signal of the frame prior to the first lost frame is not a time-domain signal obtained by correctly decoding, performing adjustment on the estimated pitch period value obtained by the pitch period estimation, preferably, wherein performing adjustment on the estimated pitch period value comprises:

searching to obtain largest-magnitude positions $i_1$ and $i_2$ of the initially compensated signal of the first lost frame within time intervals [0,T−1] and [T,2T−1] respectively, wherein, T is an estimated pitch period value obtained by estimation, and if the following condition that $q_1T<i_2-i_1<q_2T$ and $i_2-i_1$ is less than a half of the frame length is satisfied, wherein $0\le q_1\le 1\le q_2$, modifying the estimated pitch period value to $i_2-i_1$, and if the above condition is not satisfied, not modifying the estimated pitch period value.

9. The method according to claim 1, further comprising:

for a second lost frame immediately following the first lost frame, judging a frame type of the second lost frame, and when the second lost frame is a non-multi-harmonic frame, calculating MDCT coefficients of the second lost frame by using MDCT coefficients of one or more frames prior to the second lost frame;

obtaining an initially compensated signal of the second lost frame according to the MDCT coefficient of the second lost frame; and performing a waveform adjustment on the initially compensated signal of the second lost frame and taking an adjusted time-domain signal as a time-domain signal of the second lost frame, preferably, wherein, performing a waveform adjustment on the initially compensated signal of the second lost frame comprises:

performing overlap-add on a part $M_1$ exceeding a frame length of the time-domain signal obtained during the compensation of the first lost frame and the initially compensated signal of the second lost frame to obtain a time-domain signal of the second lost frame, wherein, a length of the overlapped area is $M_1$, and in the overlapped area, a descending window is used for the part exceeding a frame length of the time-domain signal obtained during the compensation of the first lost frame and an ascending window with a same length as that of the descending window is used for first $M_1$ samples of the initially compensated signal of the second lost frame, and data obtained by windowing and then adding is taken as data of first $M_1$ samples of the time-domain signal of the second lost frame, and data of remaining samples are supplemented with data of samples of the initially compensated signal of the second lost frame outside the overlapped area, or, wherein, the method further comprises:

for a third lost frame immediately following the second lost frame and a lost frame following the third lost frame, judging a frame type of the lost frame, and when the lost frame is a non-multi-harmonic frame, calculating MDCT coefficients of the lost frame by using MDCT coefficients of one or more frames prior to the lost frame;

obtaining an initially compensated signal of the lost frame according to the MDCT coefficients of the lost frame; and taking the initially compensated signal of the lost frame as a time-domain signal of the lost frame.

10. The method according to of claim 1, further comprising:

when the first lost frame is a non-multi-harmonic frame, performing processing on a correctly received frame immediately following the first lost frame as follows:

decoding to obtain the time-domain signal of the correctly received frame; performing adjustment on the estimated pitch period value used during the compensation of the first lost frame; and performing forward overlapped periodic extension by taking a last pitch period of the time-domain signal of the correctly received frame as a reference waveform, to obtain a time-domain signal of a frame length; and performing overlap-add on a part exceeding a frame length of the time-domain signal obtained during the compensation of the first lost frame and the time-domain signal obtained by the extension, and taking the obtained signal as the time-domain signal of the correctly received frame, preferably, wherein, performing adjustment on the estimated pitch period value used during the compensation of the first lost frame comprises:

searching to obtain largest-magnitude positions $\mathbf{1}_3$ and $i_4$ of the time-domain signal of the correctly received frame within time intervals [L−2T−1, L−T−1] and [L−T,L−1] respectively, wherein, T is an estimated pitch period value used during the compensation of the first lost frame and L is a frame length, and if the following condition that $q_1T<i_4-i_3<q_2T$ and $i_4-i_3<L/2<L/2$ is satisfied wherein $0\le q_1\le 1\le q_2$, modifying the estimated pitch period value to $i_4-i_3$, and if the above condition is not satisfied, not modifying the estimated pitch period value, or, wherein, performing forward overlapped periodic extension by taking a last pitch period of the time-domain signal of the correctly received frame as a reference waveform, to obtain a time-domain signal of a frame length comprises:

performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

11. A frame loss compensation method for audio signals, comprising:

when a first frame immediately following a correctly received frame is lost, and the first frame which is lost, a first lost frame for short hereinafter, is a non-multi-harmonic frame, processing a correctly received frame immediately following the first lost frame as follows:

decoding to obtain a time-domain signal of the correctly received frame; performing adjustment on an estimated pitch period value used during compensation of the first lost frame; and performing forward overlapped periodic extension by taking a last pitch period of the time-domain signal of the correctly received frame as a reference waveform to obtain a time-domain signal of a frame length; and performing overlap-add on a part exceeding a frame length of the time-domain signal obtained during the compensation of the first lost frame and the time-domain signal obtained by the extension, and taking the obtained signal as the time-domain signal of the correctly received frame.

12. The method according to claim 11, wherein, performing adjustment on an estimated pitch period value used during compensation of the first lost frame comprises:

searching to obtain largest-magnitude positions $i_3$ and $i_4$ of the time-domain signal of the correctly received frame within time intervals [L−2T−1, L−T−1] and [L−T,L−1] respectively, wherein, T is an estimated pitch period value used during the compensation of the first lost frame and L is the frame length, and if the following condition that $q_1T<i_4-i_3<q_2T$ and $i_4-i_3<L/2$ is satisfied wherein $0\le q_1\le 1\le q_2$, modifying the estimated pitch period value to $i_4-i_3$, and if the above condition is not satisfied, not modifying the estimated pitch period value, or, wherein, performing forward overlapped periodic extension by taking a last pitch period of the time-domain signal of the correctly received frame as a reference waveform to obtain a time-domain signal of a frame length comprises:

performing periodic duplication forward in time on a waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

13. A frame loss compensation apparatus for audio signals, comprising a frame type judgment module, an Modified Discrete Cosine Transform (MDCT) coefficient acquisition module, an initial compensation signal acquisition module and an adjustment module, wherein, the frame type judgment module is configured to, when a first frame immediately following a correctly received frame is lost, judge a frame type of the first frame which is lost, a first lost frame for short hereinafter;

the MDCT coefficient acquisition module is configured to calculate MDCT coefficients of the first lost frame by using MDCT coefficients of one or more frames prior to the first lost frame when the judgment module judges that the first lost frame is a non-multi-harmonic frame;

the initial compensation signal acquisition module is configured to obtain an initially compensated signal of the first lost frame according to the MDCT coefficients of the first lost frame; and the adjustment module is configured to perform a waveform adjustment on the initially compensated signal of the first lost frame and take a time-domain signal obtained after adjustment as a time-domain signal of the first lost frame.

14. The apparatus according to claim 13, wherein, the frame type judgment module is configured to judge a frame type of the first lost frame by means of:

judging the frame type of the first lost frame according to a frame type flag bit set by an encoding apparatus in a code stream, preferably, wherein, the frame type judgment module is configured to judge the frame type of the first lost frame according to a frame type flag bit set by an encoding end in a code stream by means of:

the frame type judgment module acquiring a frame type flag of each of n frames prior to the first lost frame, and if a number of multi-harmonic frames in the prior n frames is larger than a second threshold $n_0$, wherein $0\le n_0\le n$, $n\ge 1$, considering the first lost frame as a multi-harmonic frame and setting the frame type flag as a multi-harmonic type; and if the number is not larger than the second threshold, considering the first lost frame as a non-multi-harmonic frame and setting the frame type flag as a non-multi-harmonic type.

15. The apparatus according to claim 13, wherein, the adjustment module includes a first waveform adjustment unit, which includes a pitch period estimation unit, a short pitch detection unit and a waveform extension unit, wherein, the pitch period estimation unit is configured to perform pitch period estimation on the first lost frame;

the short pitch detection unit is configured to perform short pitch detection on the first lost frame;

the waveform extension unit is configured to perform waveform adjustment on the initially compensated signal of the first lost frame with a usable pitch period and without a short pitch period by means of: performing overlapped periodic extension on the time-domain signal of the frame prior to the first lost frame by taking a last pitch period of the time-domain signal of the frame prior to the first lost frame as a reference waveform, to obtain a time-domain signal of a length larger than a frame length, wherein during the extension, a gradual convergence is performed from a waveform of the last pitch period of the time-domain signal of the prior frame to a waveform of the first pitch period of the initially compensated signal of the first lost frame, taking a first frame length of the time-domain signal in the time-domain signal of a length larger than a frame length obtained by the extension as a compensated time-domain signal of the first lost frame, and using a part exceeding the frame length for smoothing with a time-domain signal of a next frame.

16. The apparatus according to claim 15, wherein, the pitch period estimation unit is configured to perform pitch period estimation on the first lost frame by means of:

performing pitch search on the time signal of the frame prior to the first lost frame using an autocorrelation approach, to obtain the pitch period and a largest normalized autocorrelation coefficient of the time-domain signal of the prior frame, and taking the obtained pitch period as an estimated pitch period value of the first lost frame; and judging whether the estimated pitch period value of the first lost frame is usable by means of: if any of the following conditions is satisfied, considering that the estimated pitch period value of the first lost frame is unusable:

a zero-crossing rate of the initially compensated signal of the first lost frame is larger than a third threshold $Z_1$, wherein $Z_1>0$;

the largest normalized autocorrelation coefficient of the time-domain signal of the frame prior to the first lost frame is less than a fourth threshold $R_1$ or a largest magnitude within the first pitch period of the time-domain signal of the frame prior to the first lost frame is $\lambda$ times larger than the largest magnitude within the last pitch period, wherein $0<R_1<1$ and $\lambda\geq 1$;

the largest normalized autocorrelation coefficient of the time-domain signal of the frame prior to the first lost frame is less than a fifth threshold $R_2$ or a zero-crossing rate the time-domain signal of the frame prior to the first lost frame is larger than a sixth threshold $Z_2$, wherein $0<R_2<1$ and $Z_2>0$, preferably, wherein, the pitch period estimation unit is further configured to before performing pitch search on the time-domain signal of the frame prior to the first lost frame using an autocorrelation approach, firstly perform low-pass filtering or down-sampling processing on the initially compensated signal of the first lost frame and the time-domain signal of the frame prior to the first lost frame, and perform the pitch period estimation by substituting the original initially compensated signal and the time-domain signal of the frame prior to the first lost frame with the initially compensated signal and the time-domain signal of the frame prior to the first lost frame after low-pass filtering or down-sampling.

17. The apparatus according to claim 15, wherein, the short pitch detection unit is configured to perform short pitch detection on the first lost frame by means of:

detecting whether the frame prior to the first lost frame has a short pitch period, and if so, considering that the first lost frame also has the short pitch period, and if not, considering that the first lost frame does not have the short pitch period either;

wherein, the short pitch detection unit is configured to detect whether the frame prior to the first lost frame has a short pitch period by means of:

detecting whether the frame prior to the first lost frame has a pitch period between $T'_{min}$ and $T'_{max}$, wherein $T'_{min}$ and $T'_{max}$ satisfy a condition that $T'_{min}<T'_{max}\leq$a lower limit $T_{min}$ of the pitch period during the pitch search, during the detection, performing pitch search on the time-domain signal of the frame prior to the first lost frame using an autocorrelation approach, and when a largest normalized autocorrelation coefficient is larger than a seventh threshold $R_3$, considering that the short pitch period exists, wherein $0<R_3<1$, or, wherein, the waveform extension unit is configured to perform overlapped periodic extension by taking a last pitch period of the time-domain signal of the frame prior to the first lost frame as a reference waveform by means of:

performing periodic duplication later in time on the waveform of the last pitch period of the time-domain signal of the frame prior to the first lost frame taking the pitch period as a length, wherein during the duplication, a signal of a length larger than one pitch period is duplicated each time and an overlapped area is generated between the signal duplicated each time and the signal duplicated last time, and performing windowing and adding processing on the signals in the overlapped area.

18. The apparatus according to claim 15, wherein, the first waveform adjustment unit further comprises a pitch period adjustment unit, configured to perform adjustment on the estimated pitch period value obtained from estimation by the pitch period estimation unit and transmit the adjusted estimated pitch period value to the waveform extension unit when it is judged that the time-domain signal of the frame prior to the first lost frame is not a time-domain signal obtained by correctly decoding, preferably, wherein, the pitch period adjustment unit is configured to perform adjustment on the estimated pitch period value by means of:

searching to obtain largest-magnitude positions $i_1$ and $i_2$ of the initially compensated signal of the first lost frame within time intervals [0,T−1] and [T,2T−1] respectively, wherein, T is an estimated pitch period value obtained by estimation, and if the following condition that $q_1T<i_2-i_1<q_2T$ and $i_2-i_1$ is less than a half of the frame length is satisfied, wherein $0\leq q_1\leq 1\leq q_2$, modifying the estimated pitch period value to $i_2-i_1$, and if the above condition is not satisfied, not modifying the estimated pitch period value.

19. The apparatus according to claim 13, wherein, the frame type judgment module is further configured to, when a second lost frame immediately following the first lost frame is lost, judge a frame type of the second lost frame;

the MDCT coefficient acquisition module is further configured to calculate MDCT coefficients of the second lost frame by using MDCT coefficients of one or more frames prior to the second lost frame when the frame type judgment module judges that the second lost frame is a non-multi-harmonic frame;

the initial compensation signal acquisition module is further configured to obtain an initially compensated signal of the second lost frame according to the MDCT coefficients of the second lost frame; and the adjustment module is further configured to perform a waveform adjustment on the initially compensated signal of the second lost frame and take an adjusted time-domain signal as a time-domain signal of the second lost frame, preferably, wherein, the adjustment module further comprises a second waveform adjustment unit, configured to perform a waveform adjustment on the initially compensated signal of the second lost frame by means of:

performing overlap-add on a part M1 exceeding a frame length of the time-domain signal obtained during the compensation of the first lost frame and the initially compensated signal of the second lost frame to obtain a time-domain signal of the second lost frame, wherein, a length of the overlapped area is M1, and in the overlapped area, a descending window is used for a part exceeding a frame length of the time-domain signal obtained during the compensation of the first lost frame, and an ascending window with a same length as that of the descending window is used for first M1 samples of the initially compensated signal of the second lost frame, and data obtained by windowing and then adding is taken as data of first M1 samples of the time-domain signal of the second lost frame, and data of remaining samples are supplemented with data of samples of the initially compensated signal of the second lost frame outside the overlapped area, or, wherein, the frame type judgment module is further configured to when a third lost frame immediately following the second lost frame and a frame following the third lost frame are lost, judge frame types of the lost frames;

the MDCT coefficient acquisition module is further configured to calculate MDCT coefficients of the currently lost frame by using MDCT coefficients of one or more frames prior to the currently lost frame when the frame type judgment module judges that the currently lost frame is a non-multi-harmonic frame;

the initial compensation signal acquisition module is further configured to obtain an initially compensated signal of the currently lost frame according to the MDCT coefficients of the currently lost frame; and the adjustment module is further configured to take the initially compensated signal of the currently lost frame as a time-domain signal of the currently lost frame.

20. The apparatus according to claim 13, wherein, the apparatus further comprises a normal frame compensation module, configured to, when a first frame immediately following a correctly received frame is lost and the first lost frame is a non-multi-harmonic frame, process a correctly received frame immediately following the first lost frame, wherein, the normal frame compensation module comprises a decoding unit, a time-domain signal adjustment unit, wherein, the decoding unit is configured to decode to obtain the time-domain signal of the correctly received frame; and the time-domain signal adjustment unit is configured to perform adjustment on the estimated pitch period value used during the compensation of the first lost frame; and perform forward overlapped periodic extension by taking a last pitch period of the time-domain signal of the correctly received frame as a reference waveform, to obtain a time-domain signal of a frame length; and perform overlap-add on a part exceeding a frame length of the time-domain signal obtained during the compensation of the first lost frame and the time-domain signal obtained by the extension, and take the obtained signal as the time-domain signal of the correctly received frame, preferably, wherein, the time-domain signal adjustment unit is configured to perform adjustment on the estimated pitch period value used during the compensation of the first lost frame by means of:

searching to obtain largest-magnitude positions $i_3$ and $i_4$ of the time-domain signal of the correctly received frame within time intervals [L−2T−1, L−T−1] and [L−T,L−1] respectively, wherein, T is an estimated pitch period value used during the compensation of the first lost frame and L is a frame length, and if the following condition that $q_1T<i_4-i_3<q_2T$ and $i_4-i_3<L/2$ is satisfied, wherein $0\le q_1\le 1\le q_2$, modifying the estimated pitch period value to $i_4-i_3$, and if the above condition is not satisfied, not modifying the estimated pitch period value, or, wherein, the time-domain signal adjustment unit is configured to perform forward overlapped periodic extension by taking a last pitch period of the time-domain signal of the correctly received frame as a reference waveform, to obtain a time-domain signal of a frame length by means of:

performing periodic duplication forward in time on the waveform of the last pitch period of the time-domain signal of the correctly received frame taking the pitch period as a length, until a time-domain signal of a frame length is obtained, wherein during the duplication, a signal of a length larger than one pitch period is duplicated each time and an overlapped area is generated between the signal duplicated each time and the signal duplicated last time, and performing windowing and adding processing on the signals in the overlapped area.

* * * * *